US012747876B2

(12) United States Patent
Kim et al.

(10) Patent No.: US 12,747,876 B2
(45) Date of Patent: Sep. 29, 2026

(54) HUMIDIFIER

(71) Applicant: LG ELECTRONICS INC., Seoul (KR)

(72) Inventors: Yongmin Kim, Seoul (KR); Jaeheuk Choi, Seoul (KR); Dongryul Park, Seoul (KR); Chiyoung Choi, Seoul (KR); Jeonghoon Lee, Seoul (KR)

(73) Assignee: LG ELECTRONICS INC., Seoul (KR)

( * ) Notice: Subject to any disclaimer, the term of this patent is extended or adjusted under 35 U.S.C. 154(b) by 336 days.

(21) Appl. No.: 18/539,434

(22) Filed: Dec. 14, 2023

(65) Prior Publication Data

US 2024/0200802 A1 Jun. 20, 2024

(30) Foreign Application Priority Data

Dec. 19, 2022 (KR) ..... 10-2022-0177807

(51) Int. Cl.

| | |
|---|---|
| ***F24F 6/02*** | (2006.01) |
| ***F24F 6/10*** | (2006.01) |
| *F24F 6/00* | (2006.01) |
| *F24F 6/12* | (2006.01) |

(52) U.S. Cl.

CPC ..... *F24F 6/025* (2013.01); *F24F 6/02* (2013.01); *F24F 6/10* (2013.01); *F24F 2006/008* (2013.01); *F24F 6/12* (2013.01)

(58) Field of Classification Search

CPC ..... F24F 2006/008; F24F 6/025
USPC ..... 261/DIG. 4, DIG. 15
See application file for complete search history.

(56) References Cited

U.S. PATENT DOCUMENTS

| | | | |
|---|---|---|---|
| 6,244,576 B1 | 6/2001 | Tsai | |
| 2021/0222895 A1 | 7/2021 | Bae et al. | |
| 2021/0262678 A1* | 8/2021 | Pi | C02F 1/32 |

FOREIGN PATENT DOCUMENTS

| | | |
|---|---|---|
| KR | 20-0440884 | 7/2008 |
| KR | 10-102464864 | 11/2022 |
| WO | WO 2008/060089 | 5/2008 |
| WO | WO 2021/164366 | 8/2021 |

OTHER PUBLICATIONS

European Search Report dated May 6, 2024 issued in Application No. 23217827.7.

* cited by examiner

*Primary Examiner* — Jennifer Dieterle
*Assistant Examiner* — Rachel Marie Slaugovsky
(74) *Attorney, Agent, or Firm* — KED & ASSOCIATES, LLP

(57) ABSTRACT

Disclosed is a humidifier including: a water tank for storing water; a humidifying water tank which is disposed in a lower side of the water tank, and generates humidified air by using water supplied to the water tank; a water supply pipe which is disposed in the lower side of the water tank, and supplies the water supplied from the water tank to the humidifying water tank; and an inner guider disposed spaced apart from an outer circumference of the water tank, wherein a discharge passage through which the humidified air generated in the humidifying water tank flows is formed between the water tank and the inner guide, wherein the inner guider comprises a bottom wall which has a first bottom hole, and a second bottom hole.

16 Claims, 31 Drawing Sheets

HUMIDIFIER

CROSS-REFERENCE TO RELATED APPLICATION(S)

This application claims priority under 35 U.S.C. § 119 to Korean Application No. 10-2022-0177807, filed in Korea on Dec. 19, 2022, whose entire disclosure(s) is/are hereby incorporated by reference.

BACKGROUND

1. Field

This disclosure relates to a humidifier, and more particularly, to a humidifier that generates humidified air through heating or ultrasonic vibration.

2. Background

A humidifier is an apparatus that evaporates water and discharges humidified air having high moisture content. A humidifier can generate humidified air by vaporizing water through natural evaporation, heat evaporation, or ultrasonic vibration.

Since existing humidifiers have a restricted discharge area, it is difficult to discharge humidified air over a wide area. In the case of a humidifier, since the area occupied by a water tank is large, the area where humidified air is discharged is biased to one side or an area where humidified air is discharged is provided in one side of the water tank space.

Registered patent KR 10-2464864 B1 also provides an area where humidified air is discharged is provided in one side of the water tank. In such a structure, since the area where humidified air is discharged is restricted, it may be difficult to humidify a large space.

BRIEF DESCRIPTION OF THE DRAWINGS

Embodiments will be described in detail with reference to the following drawings in which like reference numerals refer to like elements, and wherein.

DETAILED DESCRIPTION

Figure 1:
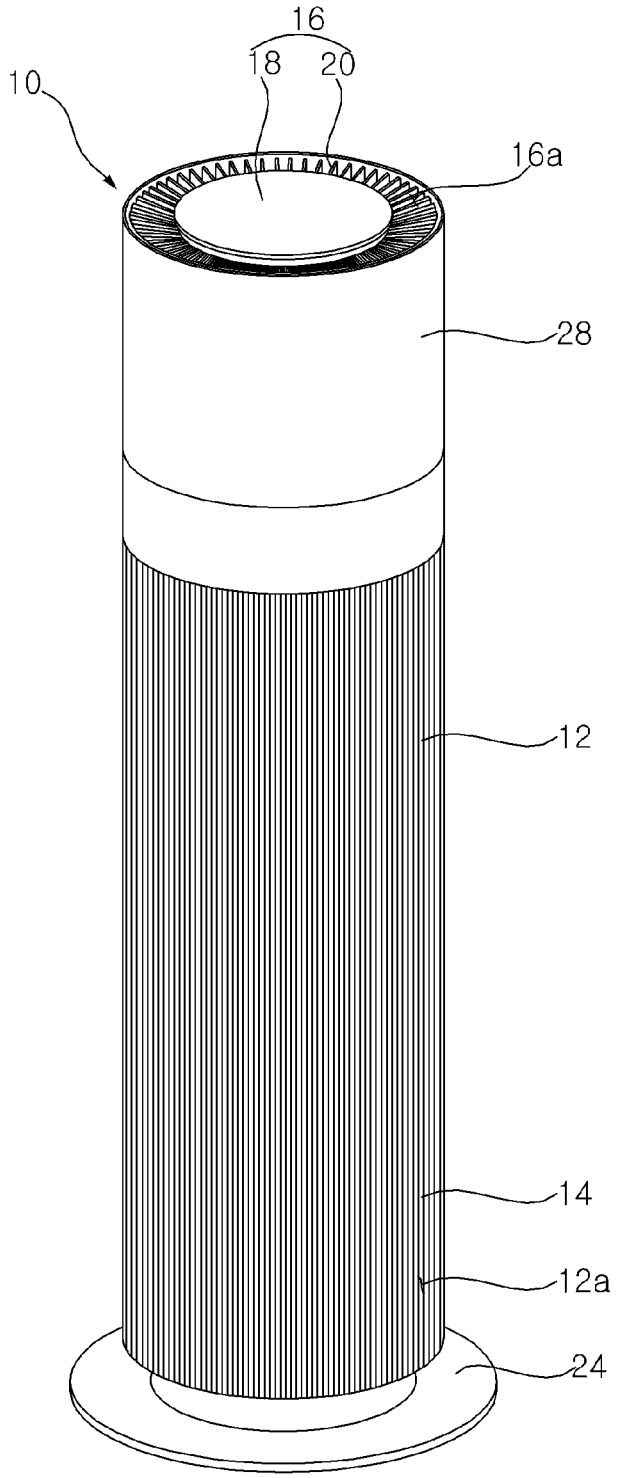
FIG. 1 is a perspective view of a humidifier according to an embodiment of the present disclosure.

Advantages and features of the present disclosure and methods of achieving them will become apparent with reference to the embodiments described below in detail in conjunction with the accompanying drawings. However, the present disclosure is not limited to the embodiments disclosed below, but may be implemented in various different forms, and these embodiments are provided only to allow the disclosure of the present disclosure to be complete, and to completely inform those of ordinary skill in the art to which the present disclosure belongs, the scope of the invention, and the present disclosure is only defined by the scope of the claims. Like reference numerals refer to like elements throughout.

Expressions such as 'first', 'second', and 'third' expressed in the description are intended to distinguish the composition and do not indicate the order of composition.

Hereinafter, the present disclosure will be described with reference to the drawings for explaining a humidifier according to embodiments of the present disclosure.

<Overall Composition>

A humidifier of the present disclosure may humidify water by using ultrasonic vibration. The humidifier of the present disclosure may discharge humidified air by heating water. The humidifier of the present disclosure may discharge humidified air generated by ultrasonic vibration and humidified air generated by heating.

Figure 2:
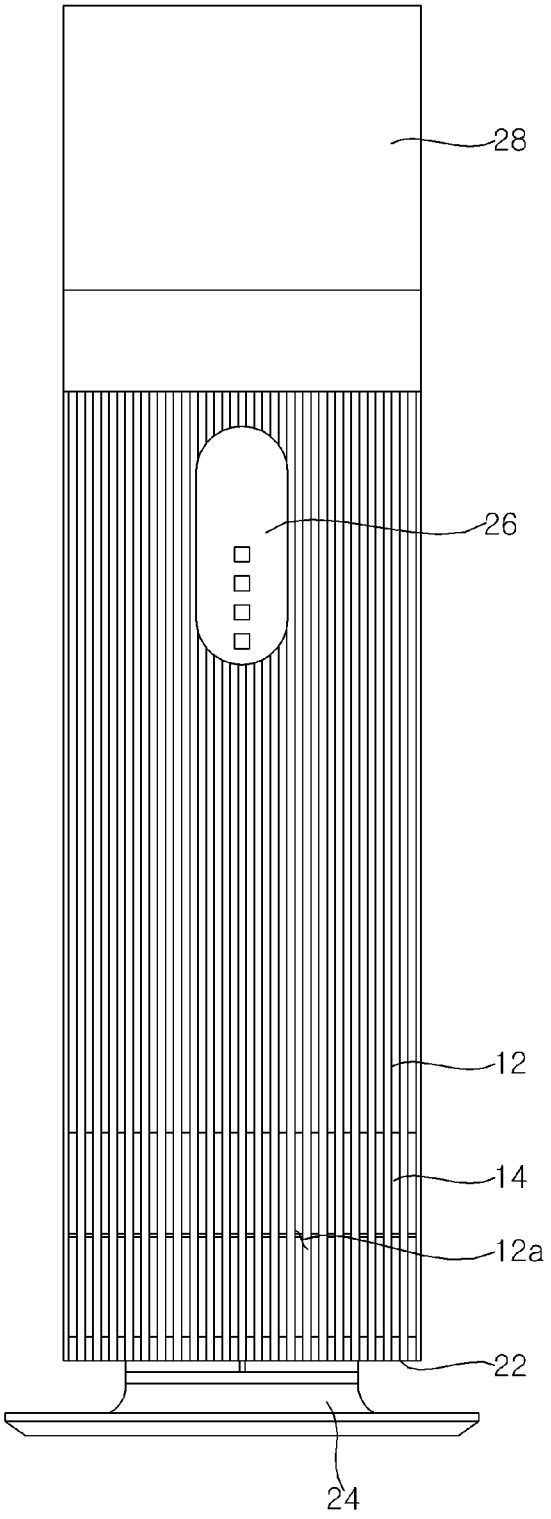
FIG. 2 is a front view of a humidifier according to an embodiment of the present disclosure.
Figure 3:
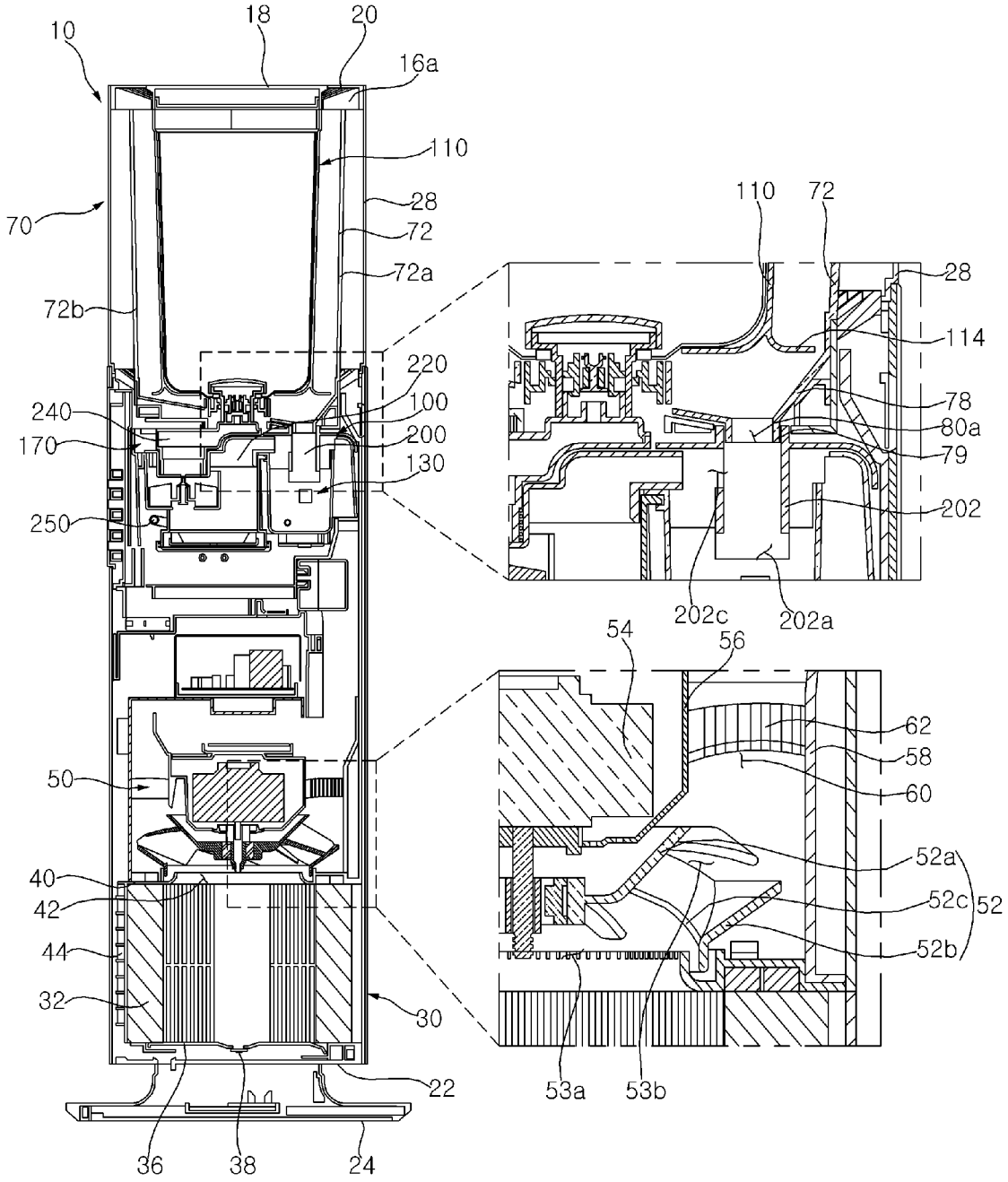
FIG. 3 is a side cross-sectional view of a humidifier according to an embodiment of the present disclosure.

Referring to FIGS. 1 to 3, the humidifier may include a cover 10 that forms an outer shape and has an inlet 12*a* and an outlet 16*a*, a cleaning device 30 that is disposed inside the cover 10 and filters the air flowing into the inlet 12*a*, a blower 50 that is disposed inside the cover 10 and flows the air inside the cover 10 from the inlet 12*a* to the outlet 16*a*, a humidification device 100 that is disposed inside the cover 10 and humidifies a portion of the air flowing to the blower 50, and a discharge guider 70 that sends the air filtered by the cleaning device 30 or the air humidified by the humidification device 100 to the outlet 16*a*.

<Cover>

The cover 10 may have an overall cylindrical shape.

The cover 10 may include an inlet cover 12 forming an inlet 12*a* through which air flows in, and an outlet cover 16 forming an outlet 16*a* through which air is discharged.

The inlet 12*a* may be formed on the circumferential surface of the cover 10 having a cylindrical shape. The outlet 16*a* may be formed on the upper surface of the cover 10 having a cylindrical shape. The humidifier of the present disclosure may flow air into the circumferential surface and discharge air to the upper surface.

Referring to FIG. 3, the inlet cover 12 may cover the outside of the filter 32 and a blowing housing 58, which will be described below. A plurality of inlets 12*a* may be formed in the inlet cover 12 in the up-down direction and spaced apart in the circumferential direction. The inlet cover 12 may have a plurality of inlets 12*a* that are formed in the up-down direction, and spaced apart in the circumferential direction. The inlet 12*a* may be formed around where the filter 32 is disposed. The inlet 12*a* may be formed in the lower portion of the inlet cover 12.

A plurality of inlet grills 14 extending in the up-down direction are disposed in the inlet cover 12. The plurality of inlet grills 14 may be disposed to be spaced apart in the circumferential direction of the inlet cover 12. A plurality of inlets 12*a* may be formed between the plurality of inlet grills 14.

The inlet cover 12 may be divided into an inlet cover lower part 13*b* where the inlet 12*a* is formed and an inlet cover upper part 13*a* disposed in the upper side of the inlet cover lower part 13*b*. An input panel 26, which will be described below, may be disposed in the inlet cover upper part 13*a*. The inlet cover upper part 13*a* may cover the outer side of the blowing housing 58, and a humidifying water tank 130 and a heating water tank 170 which will be described below.

The outlet cover 16 may have a structure that is separated upward from the outer guider 28 described below. Referring to FIG. 3, the outlet cover 16 may include a water tank cover 18 that covers the upper side of the water tank 110, and a plurality of discharge grills 20 extending in a radial direction from the outer circumference of the water tank cover 18. A plurality of discharge grills 20 may be disposed to be spaced apart in the circumferential direction on the outer circumference of the water tank cover 18.

Referring to FIG. 1, the discharge grill 20 has a structure extending in a radial direction from the outer circumference of the water tank cover 18. A plurality of discharge grills 20 may be disposed in the upper sides of a first discharge passage 74 and a second discharge passage 76 which will be described below. The plurality of discharge grills 20 may be disposed to be spaced apart in the circumferential direction. A plurality of outlets 16*a* may be formed between the plurality of discharge grills 20.

The air flowing through the first discharge passage 74 and the air flowing through the second discharge passage 76 may be mixed between the plurality of discharge grills 20. In each of the plurality of discharge grills 20, the height of the outer circumferential end is formed to be higher than the height of the inner circumferential end. Accordingly, the air flowing through the first discharge passage 74 and the second discharge passage 76 may be guided inward in the radial direction.

The cover 10 may include an outer guider 28 that guides the air flowing inside to the outlet 16*a*. The outer guider 28 may be included in the configuration of the discharge guider 70 described below.

The cover 10 may include a lower cover 22 that covers the lower side of the inlet cover 12.

The humidifier may include a pedestal 24 that is disposed in the lower side of the cover 10 and separates the lower cover 22 from the ground by a certain distance. The upper end of the pedestal 24 may be connected to the lower cover 22. The lower cover 22 may be disposed to cover the lower surface of the humidifier spaced upward from the ground by the pedestal 24.

Referring to FIG. 2, an input panel 26 is disposed in one side of the cover 10. The input panel 26 allows a user to control the power or operation of the humidifier. A display for displaying the operating state or the like of the humidifier to a user may be disposed in the input panel 26.

<Cleaning Device>

The cleaning device 30 may filter the air introduced through the inlet 12*a* through the filter 32. The cleaning device 30 may flow the filtered air upward.

Referring to FIG. 3, the cleaning device 30 includes a filter 32 that filters the air flowing into the inlet 12*a*, and a filter mounter 34 that fixes the dislocation of the filter 32 inside the cover 10.

The filter 32 may have a cylindrical shape. Accordingly, the filter 32 may filter the air sucked from the front, rear, left, and right directions perpendicular to the up-down direction. The air introduced from the inlet 12*a* may flow into the inner space of the filter 32. The air passed through the filter 32 may flow to the blower 50 disposed in the upper side of the filter 32.

The filter mounter 34 includes a filter mounting plate 36 disposed in the lower side of the filter 32, a filter upper plate 40 disposed in the upper side of the filter 32, and a filter support 44 connecting the filter mounting plate 36 and the filter upper plate 40.

The filter mounting plate 36 is disposed in the lower side of the filter 32. The filter mounting plate 36 moves up and down, and may detect whether the filter 32 is disposed. A fan sterilizing device 38 that irradiates ultraviolet light upward may be disposed in the center of the filter mounting plate 36. The fan sterilizing device 38 may sterilize the inside of the blowing fan 52 or filter 32 described below.

An orifice 42 may be formed in the filter upper plate 40. The orifice 42 may be formed in the center of the filter upper plate 40. The orifice 42 may allow the air introduced to the inner side of the filter 32 to flow to the blowing fan 52. The inner circumferential end of the filter upper plate 40 has a shape bent upward, so that air flowing upward in the inner space of the filter 32 can be guided to the blowing fan 52.

The filter support 44 may connect the filter mounting plate 36 and the filter upper plate 40. The filter support 44 may be disposed to be spaced apart in the circumferential direction.

<Blower>

The blower 50 includes a blowing fan 52 that generates airflow inside the cover 10, and a fan motor 54 that rotates the blowing fan 52.

Referring to FIG. 3, the blowing fan 52 may utilize a mixed flow fan forming a fan inlet 53*a* at one side and a fan outlet 53*b* in the opposite direction of the fan inlet 53*a* and in a centrifugal direction. The blowing fan 52 may include a hub 52*a* connected to the fan motor 54, a shroud 52*b* that is disposed spaced apart from the hub 52*a* by a certain distance and forms the fan inlet 53*a*, and a blade 52*c* extending in a radial direction to connect the hub 52*a* and the shroud 52*b*. A plurality of blades 52*c* may be disposed to be spaced apart from each other in the circumferential direction. The fan motor 54 may be disposed in the upper side of the blowing fan 52.

The blower device includes a motor housing 56 that covers the outside of the fan motor 54, and a blowing housing 58 that is disposed to be spaced outward in a radial direction from the motor housing 56 and guides the air flowing by the blowing fan 52 upward.

A blowing passage 60 through which air flowing by the blowing fan 52 flows upward may be formed between the motor housing 56 and the blowing housing 58. An inlet cover 12 may be disposed in the outside of the blowing housing 58.

The blower 50 may include a diffuser 62 that is disposed between the motor housing 56 and the blowing housing 58 and reduces the rotational component of air flowing upward by the blowing fan 52. A plurality of diffusers 62 may be disposed to be spaced apart in the circumferential direction.

<Discharge Guider>

Referring to FIG. 3, the discharge guider 70 includes an inner guider 72 disposed to be spaced toward the outside of the water tank 110 and an outer guider 28 disposed to be spaced toward the outside of the inner guider 72. The outer guider 28 may be included in some components of the cover 10.

The annular second discharge passage 76 is formed between the outer guider 28 and the inner guider 72. The first discharge passage 74 having a smaller cross-sectional area than the second discharge passage 76 is formed between the inner guider 72 and the water tank 110.

The second discharge passage 76 is disposed outside the first discharge passage 74.

The inner guider 72 includes an upper guider 72*a* disposed in the outer circumference of the water tank 110 and a lower guider 72*b* disposed below the upper guider 72*a*.

Figure 4:
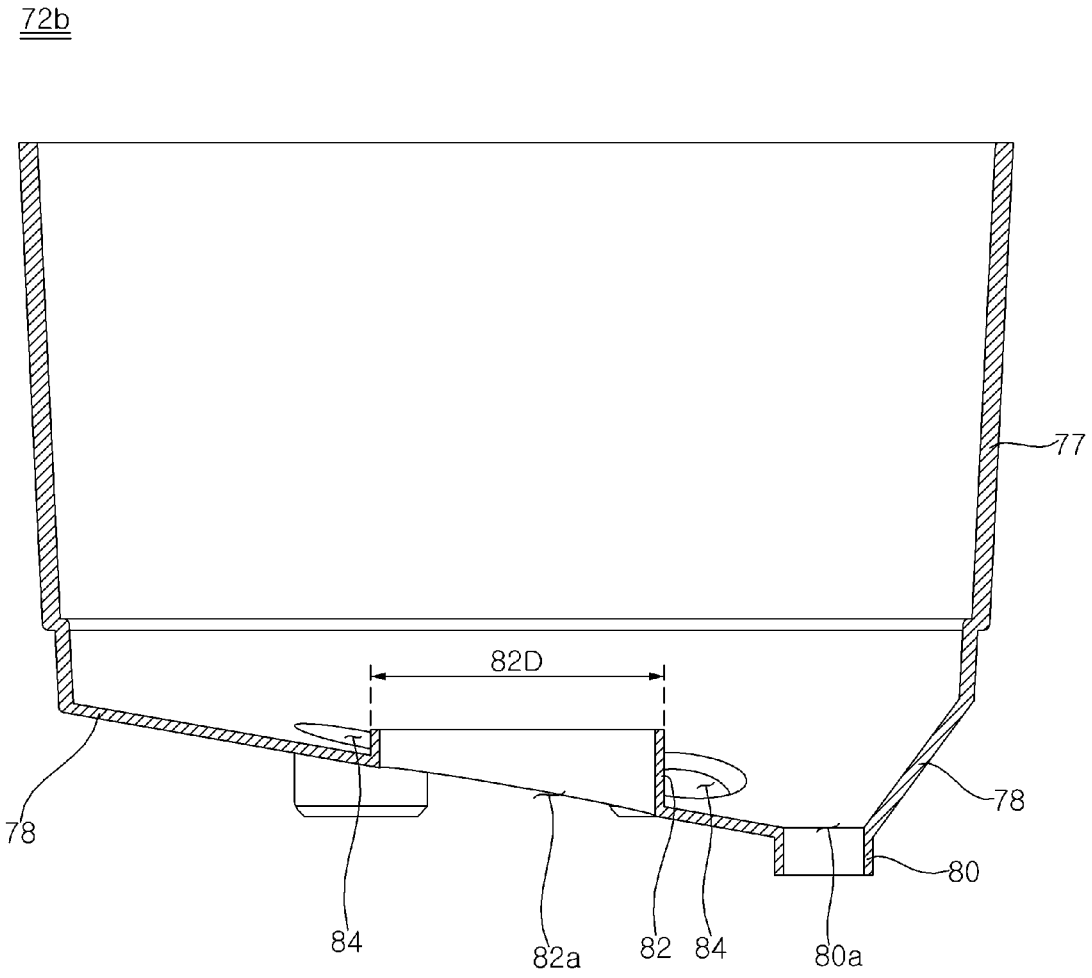
FIG. 4 is a side cross-sectional view of a lower guider of an inner guider according to an embodiment of the present disclosure.
Figure 5:
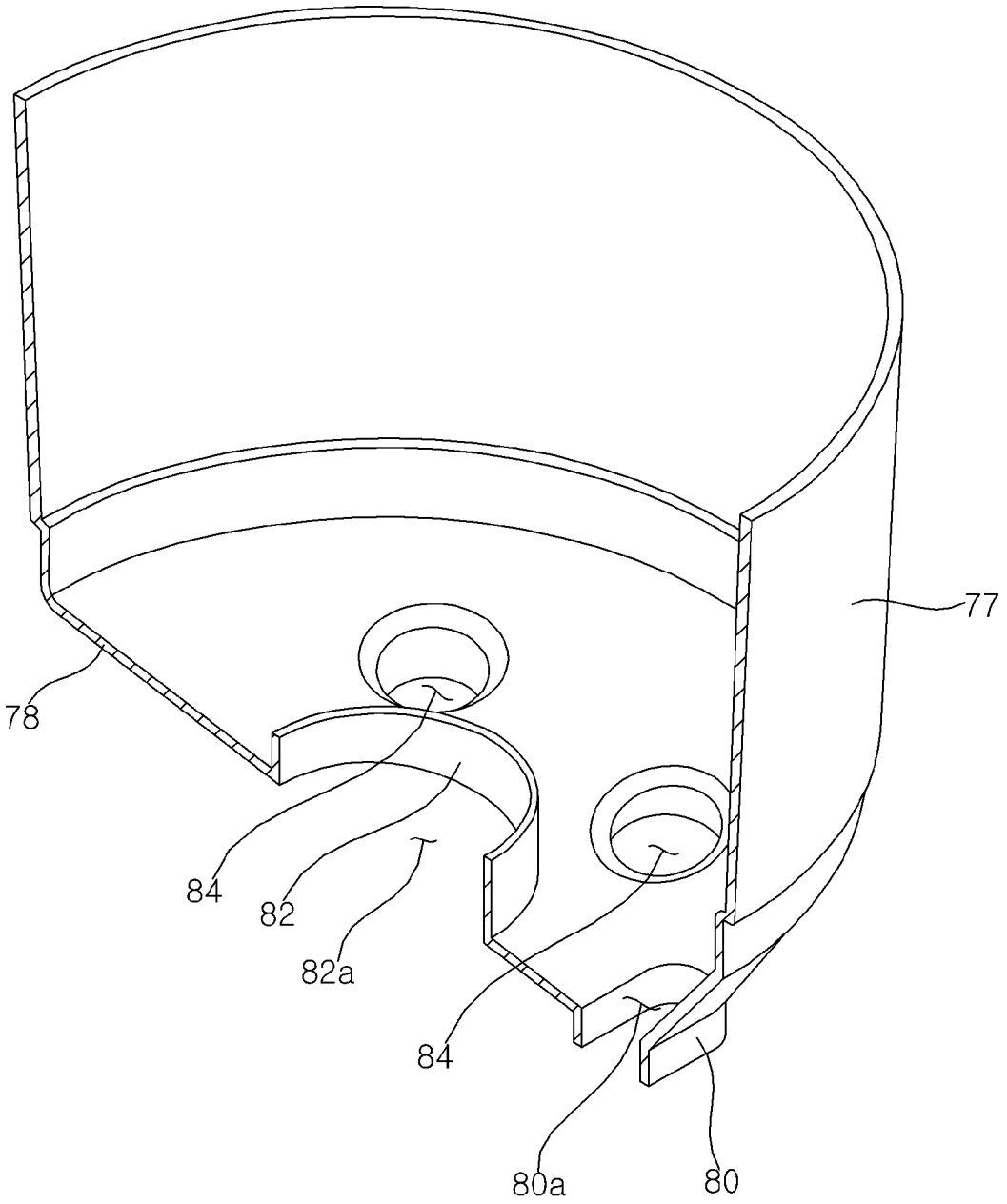
FIG. 5 is a perspective view of FIG. 4.

Referring to FIGS. 4 and 5, the lower guider 72*b* includes a bottom wall 78 that guides humidified air discharged from the humidification device 100 to the first discharge passage 76, or sends condensed water generated in the first discharge passage 76 to the humidification device 100, and a peripheral wall 77 that extends to the upper side of the bottom wall 78 and is connected to the upper guider 72*a*.

The upper end of the lower guider 72*b* may be formed at the same height so as to be connected to the inner guider 72. The upper end of the peripheral wall 77 may be connected to the upper guider 72*a*.

A first pipe 80 inserted into the exhaust pipe 202 described below is disposed in one side of the bottom wall 78. A first bottom hole 80*a* is formed inside the first pipe 80. The humidified air flowing from the humidifying chamber 130*a* through the first bottom hole 80*a* may flow into the first discharge passage 74. The condensed water generated in the first discharge passage 74 may flow into the humidifying water tank 130 through the first bottom hole 80*a*. The area of the first bottom hole 80*a* is smaller than the area of the lower surface of the water tank 110.

The bottom wall 78 may form a surface extending upward from the circumference of the first bottom hole 80*a*. A second bottom hole 82*a* may be formed in the center of the bottom wall 78. The second bottom hole 82*a* is disposed to be spaced apart from the first bottom hole 80*a*. When the water tank 110 is disposed inside the discharge guider 70, a cap 118 of the inner water tank 116 may be disposed in the second bottom hole 82*a*. The first bottom hole 80*a* may be formed at the lowest position of the bottom wall 78. The bottom wall 78 may form an inclined surface whose height increases toward the outside from an area where the first bottom hole 80*a* is formed.

The first bottom hole 80*a* is formed in a position spaced apart by a certain gap from the center of the bottom wall 78. Accordingly, the inclination angle of the inclined surface of the bottom wall 78 may vary depending on the direction in which it extends from the first bottom hole 80*a*. The inclined surface of the bottom wall 78 extending outward from the area where the first bottom hole 80*a* is formed may vary depending on the circumferential direction of the first bottom hole 80*a*. The inclined surface of the bottom wall 78 may be formed differently depending on the direction in which it is located in the circumferential surface of the first bottom hole 80*a*. Since the upper end of the bottom wall 78 is formed to be the same, the inclination angle of the bottom wall 78 is formed to be large in the area where the first bottom hole 80*a* and the outer circumferential end are located at a short distance, and the inclination angle of the bottom wall 78 is formed to be small in the area where the first bottom hole 80*a* and the outer circumferential end are located at a relatively long distance. Referring to FIG. 4, the inclination angle of the bottom wall 78 formed in the direction in which the second bottom hole 82*a* is disposed from the first bottom hole 80*a* may be formed to be the smallest. Additionally, the inclination angle of the bottom wall 78 extending from the first bottom hole 80*a* toward the opposite direction in which the second bottom hole 82*a* is disposed may be formed to be the largest. Here, the size of the inclination angle may be a relative size in the range of the inclined surface formed by the bottom wall. The bottom wall 78 may flow the condensed water generated in the first discharge passage 74 into the humidification chamber 130*a*. The condensed water generated in the first discharge passage 74 may flow into the first bottom hole 80*a* along the bottom wall 78. The condensed water flowing into the first bottom hole 80*a* may flow into the humidification chamber 130*a* through the exhaust pipe 202.

A second pipe 82 extending upward from the circumference of the second bottom hole 82*a* may be disposed on the bottom wall 78. A tank connector 119 of the inner water tank 116, which will be described below, may be disposed inside the second pipe 82. The second pipe 82 may support the disposition of the tank connector 119 disposed inside.

The height of the upper end of the second pipe 82 may be formed to be the same. Accordingly, the length of the second pipe 82 protruding upward may vary depending on the position of the bottom wall 78.

A fixing protrusion groove 84, which is spaced apart around the second bottom hole 82*a* and into which the fixing protrusion 115 of the outer water tank 112 described below is inserted, is formed in the bottom wall 78. A plurality of fixing protrusion grooves 84 may be formed in the bottom wall 78.

Therefore, when the outer water tank 112 is disposed in the upper side of the lower guider 72*b*, the plurality of fixing protrusions 115 of the outer water tank 112 may be inserted into each of the plurality of fixing protrusion grooves 84 formed in the bottom wall 78. The disposition of the outer water tank 112 may be fixed by inserting a plurality of fixing protrusions 115 into the plurality of fixing protrusion grooves 84 of the bottom wall 78 respectively.

A step may be formed at the lower end of the peripheral wall 77. The lower end of the peripheral wall 77 may form a step inward in a radial direction.

The water tank 110 includes a barrier 114 that protrudes outward in a radial direction from the lower end of an outer water tank 112 described below. The barrier 114 is formed along the outer circumference at the lower end of the outer water tank 112. The barrier 114 may be formed to have different degrees of protrusion from the outer water tank 112 depending on its distance from the first bottom hole 80*a*.

<Humidification Device>

Hereinafter, a humidification device according to an embodiment of the present disclosure will be described with reference to FIGS. 3 to 25.

The humidification device 100 may generate humidified air by heating water stored in the water tank 110. The humidification device 100 may generate humidified air by ultrasonic vibration of water stored in the water tank 110. The humidification device 100 may heat water stored in the water tank 110 and generate humidified air by using ultrasonic vibration. The humidification device 100 may generate humidified air generated by heating water and humidified air generated by ultrasonic vibration together.

Figure 6:
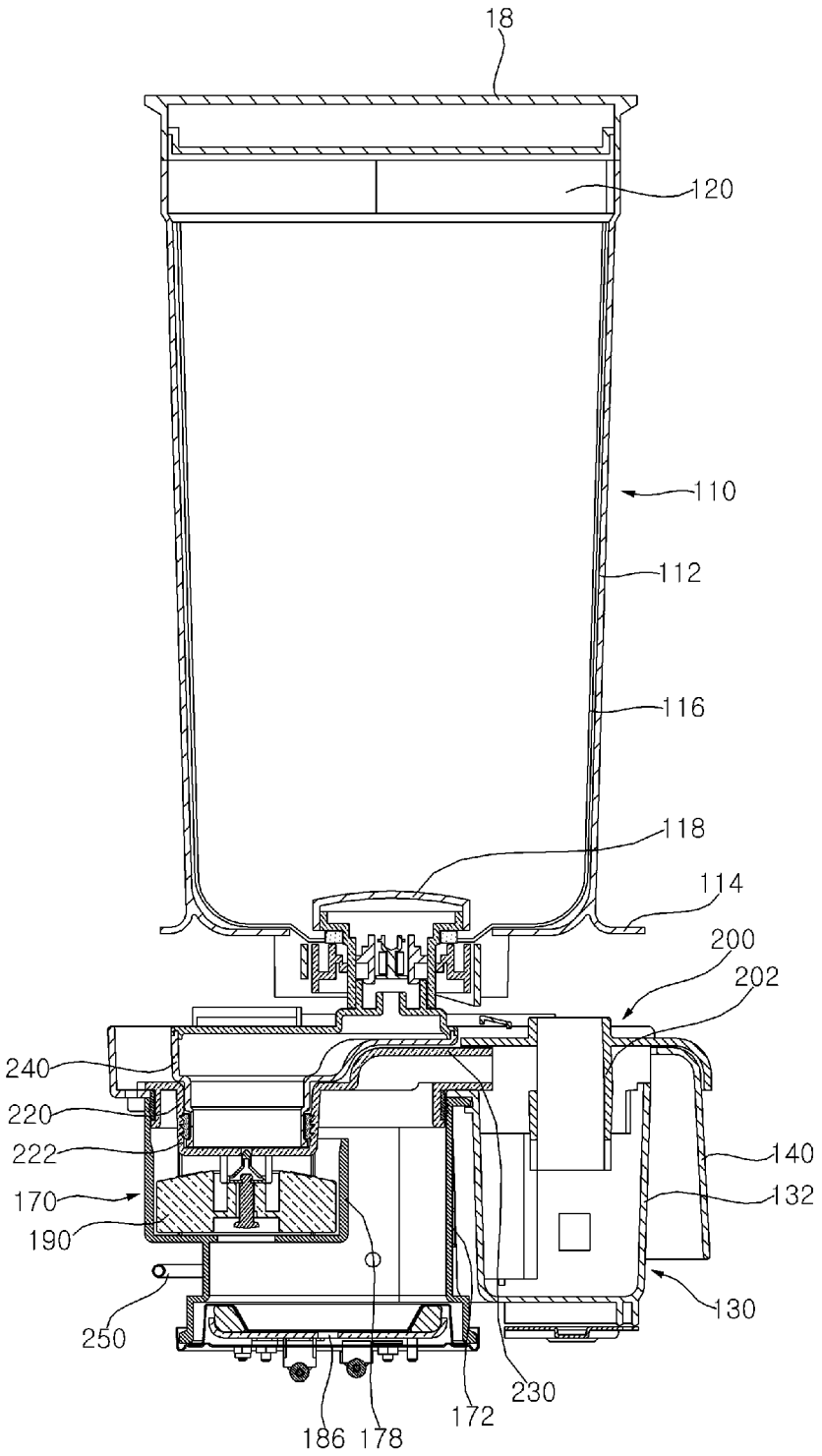
FIG. 6 is a cross-sectional view for explaining the disposition of a water tank, a heating water tank, and a humidifying water tank according to an embodiment of the present disclosure.

Referring to FIG. 6, the humidification device 100 includes a water tank 110 that stores water, a heating chamber 170*a* that receives water stored in the water tank 110 and heats the received water, and a humidifying chamber 130*a* that receives water from the heating chamber 170*a* and humidifies the received water.

The heating chamber 170*a* may mean a space in which water is heated by a heater 186 described below. A space may be contained in the inside of the heating chamber 170*a* to form a vapor generated from water heated by the heater 186. A plurality of outer circumferences forming the heating chamber 170*a* may be formed.

A space of the heating chamber 170*a* may be formed by the heating water tank 170 and a second connector 220 which will be described below.

The humidifying chamber 130*a* may mean a space in which water is humidified by an ultrasonic oscillator 162*a*, 162*b* described below. A plurality of outer circumferences forming the humidifying chamber 130*a* may be formed. A space of the humidifying chamber 130*a* may be formed by the humidifying water tank 130 and a first connector 200 described below.

The heating chamber 170*a* and the humidifying chamber 130*a* may be connected to each other through two passages 230*a* and 250*a*. The humidifying chamber 130*a* and the heating chamber 170*a* may be connected to each other below an area where a floating valve 190 described below is disposed. The humidifying chamber 130*a* and the heating chamber 170*a* may be connected to each other above the area where the floating valve 190 is disposed. The two passages through which the humidifying chamber 130*a* and the heating chamber 170*a* are connected to each other may be disposed to be spaced apart from each other in the up-down direction.

The humidifying chamber 130*a* and the heating chamber 170*a* may be connected to each other in the water storage area below an area where the floating valve 190 is disposed, and be connected to each other in a different area spaced upwardly from an area where water is stored above the floating valve 190.

The heating chamber 170*a* and the humidifying chamber 130*a* may be connected to each other through a first connection passage 250*a* and a second connection passage 230*a*. The first connection passage 250*a* may be a passage connecting the water storage areas of each of the humidifying chamber 130*a* and the heating chamber 170*a*. The water stored in the heating chamber 170*a* may flow into the humidifying chamber 130*a* through the first connection passage 250*a*.

The second connection passage 230*a* may be a passage connecting the humidifying chamber 130*a* and another area spaced upwardly from the area where the water of heating chamber 170*a* is stored. Air in the heating chamber 170*a* may flow into the humidifying chamber 130*a* through the second connection passage 230*a*.

The first connection passage 250*a* may be formed inside a connection pipe 250 (or 'first connection pipe') described below. The second connection passage 230*a* may be formed inside an air flow pipe 230 (or 'second connection pipe') described below.

Water heated in the heating chamber 170*a* may be supplied to the humidifying chamber 130*a* through the first connection passage 250*a*. Vapor generated by heating water in the heating chamber 170*a* may flow into the humidifying chamber 130*a* through the second connection passage 230*a*. Accordingly, the humidified air discharged from the humidifying chamber 130*a* may be a humidified air heated through the heating chamber 170*a* or a humidified air heated in the heating chamber 170*a* and humidified in the humidifying chamber 130*a*. That is, the humidified air discharged through the humidifying chamber 130*a* may be air that is heated and sterilized through the heating chamber 170*a*.

The humidification device 100 includes a heating water tank 170 that is disposed below the water tank 110 and heats the water stored therein. The humidification device 100 includes a humidifying water tank 130 that humidifies the water stored therein by using ultrasonic vibration. The humidification device 100 includes a connection pipe 250 that supplies water stored in the heating water tank 170 to the humidifying water tank 130. A first connection passage 250*a* may be formed inside the connection pipe 250.

The humidification device 100 includes a first connector 200 that connects the humidifying water tank 130 and the internal space of the discharge guider 70. The humidification device 100 includes a second connector 220 that connects the humidifying water tank 130 and the heating water tank 170. The humidification device 100 includes a water supply pipe 240 that supplies water discharged from the water tank 110 to the heating water tank 170.

The humidification device 100 includes a water tank cover 18 that forms a space in which the humidifying water tank 130 and the heating water tank 170 are disposed. The water tank cover 18 is disposed to be spaced radially inward from the inlet cover 12. The rising air by the blower 50 may flow between the water tank cover 18 and the inlet cover 12.

The humidification device 100 includes a water tank 110 that forms a space in which water is stored and supplies water to the humidifying water tank 130 or the heating water tank 170.

Hereinafter, the water tank 110 will be described with reference to FIGS. 6 to 10.

The water tank 110 is disposed in the upper side of the humidifying water tank 130. The water tank 110 is disposed in the upper side of the heating water tank 170. The water tank 110 has a structure that opens upward. The water tank 110 includes a cap 118 that opens and closes the opening hole formed on the lower surface. The cap 118 is disposed in the water tank 110 to be movable up and down. When the cap 118 moves upward, the opening hole may be opened.

Referring to FIG. 6, the water tank 110 of the present disclosure includes an outer water tank 112 and an inner water tank 116. The outer water tank 112 may be fixedly disposed in the inside of the cover 10, and may fix the dislocation of the inner water tank 116. The outer water tank 112 may guide the movement of the inner water tank 116 so that the inner water tank 116 is disposed at the upper end of the water supply pipe 240.

Figure 7:
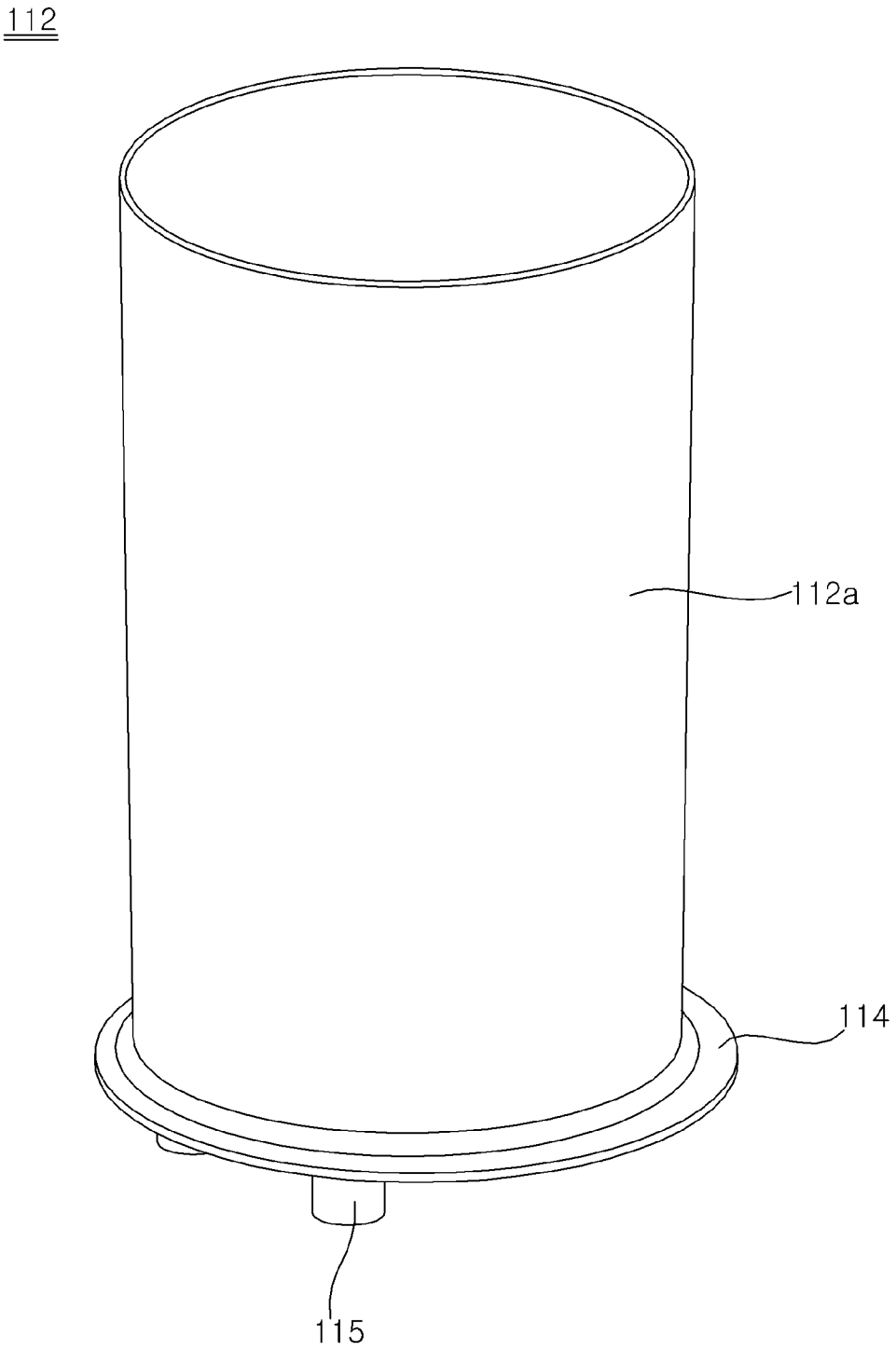
FIG. 7 is a perspective view of an outer water tank according to an embodiment of the present disclosure.

Referring to FIG. 7, the outer water tank 112 may have a bowl shape in which the upper side is open and the inner water tank 116 is disposed inside. A through-hole 113 through which the tank connector 119 or cap 118 of the inner water tank 116 penetrates may be formed in the lower surface of the outer water tank 112. Referring to FIG. 32, the lower portion of the inner water tank 116 may be disposed in the through-hole 113.

Figure 8:
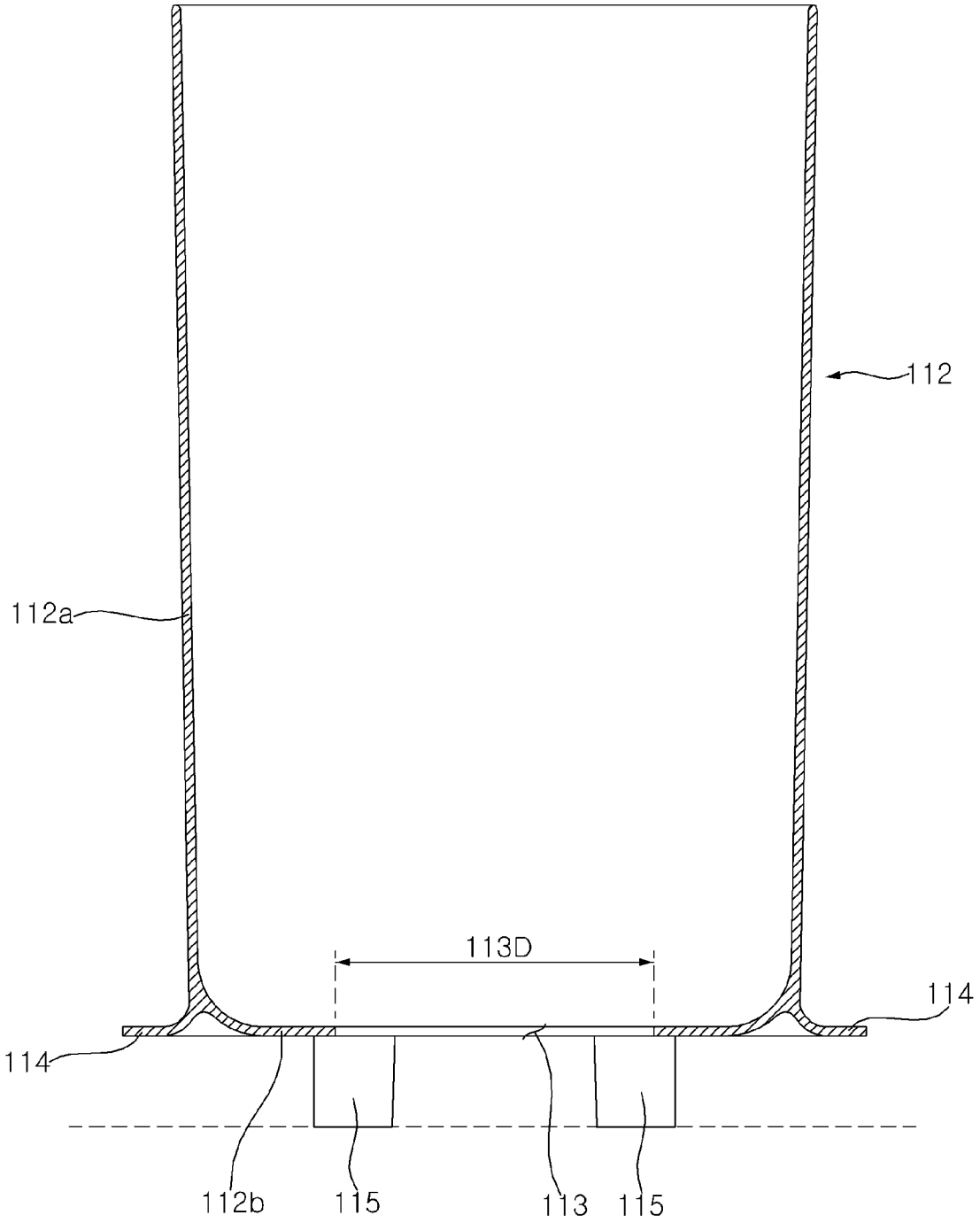
FIG. 8 is a cross-sectional view of one side of FIG. 7.

Referring to FIG. 8, the outer water tank 112 may include a cylinder wall 112*a* forming a space which has the inner water tank 116 disposed therein, and a cylinder lower wall 112*b* which is disposed in the lower side of the cylinder wall 112*a* and supports the lower portion of the inner water tank 116. A through-hole 113 may be formed in the center of the cylinder lower wall 112*b*.

The outer water tank 112 includes a plurality of fixing protrusions 115 that fix the outer water tank 112 to the lower guider 72*b*. The plurality of fixing protrusions 115 are disposed to be radially spaced apart from the through-hole 113. Each of the plurality of fixing protrusions 115 may be disposed to be spaced apart from each other in the circumferential direction.

The diameter 113D of the through-hole 113 may be larger than the diameter 80D of the outer circumferential surface of the first pipe 80. Therefore, even if the condensed water formed between the outer water tank 112 and the inner water tank 116 flows downward through the through-hole 113, it may fall to the bottom wall 78 through the outside of the first pipe 80.

The outer water tank 112 includes a barrier 114 that protrudes radially outward from the lower end of the cylinder wall 112*a*. The barrier 114 and the cylinder lower wall 112*b* may be disposed to extend in opposite directions based on the cylinder wall 112*a*.

The barrier 114 may be disposed in the upper side of the bottom wall 78, and guide the humidified air flowing into the first discharge passage 74 along the bottom wall 78 to flow evenly throughout the first discharge passage 74. The barrier 114 protrudes from the outer water tank 112 and becomes longer as it approaches the first bottom hole 80*a*.

Figure 9:
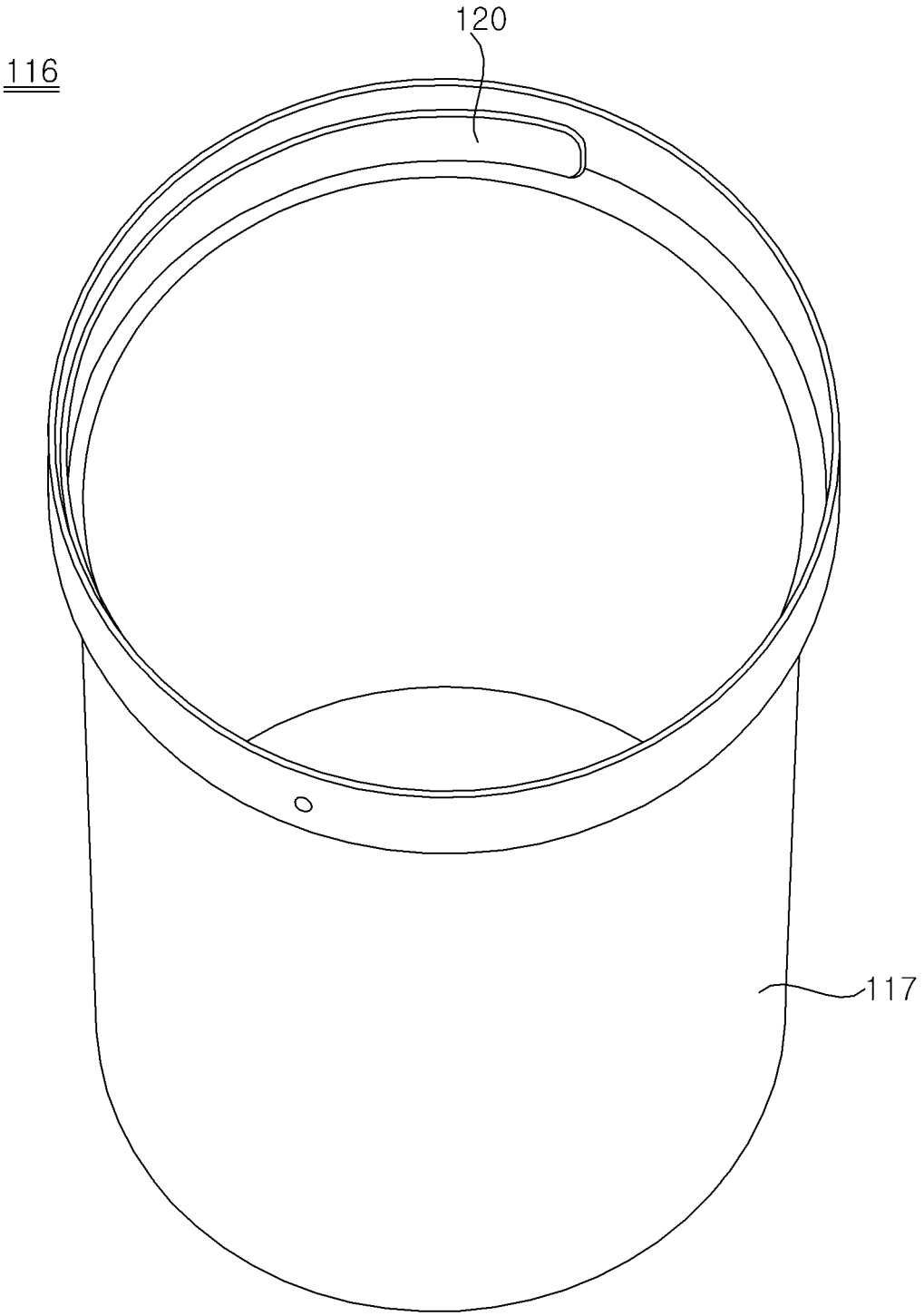
FIG. 9 is a perspective view of an inner water tank according to an embodiment of the present disclosure.

Referring to FIG. 9, the inner water tank 116 has a bowl shape in which water is stored therein. The inner water tank 116 has an open upper side. The inner water tank 116 has a tank hole 116*a* formed in the lower side. The cap 118 is disposed in the lower side of the inner water tank 116 to open and close the tank hole 116*a*.

Figure 10:
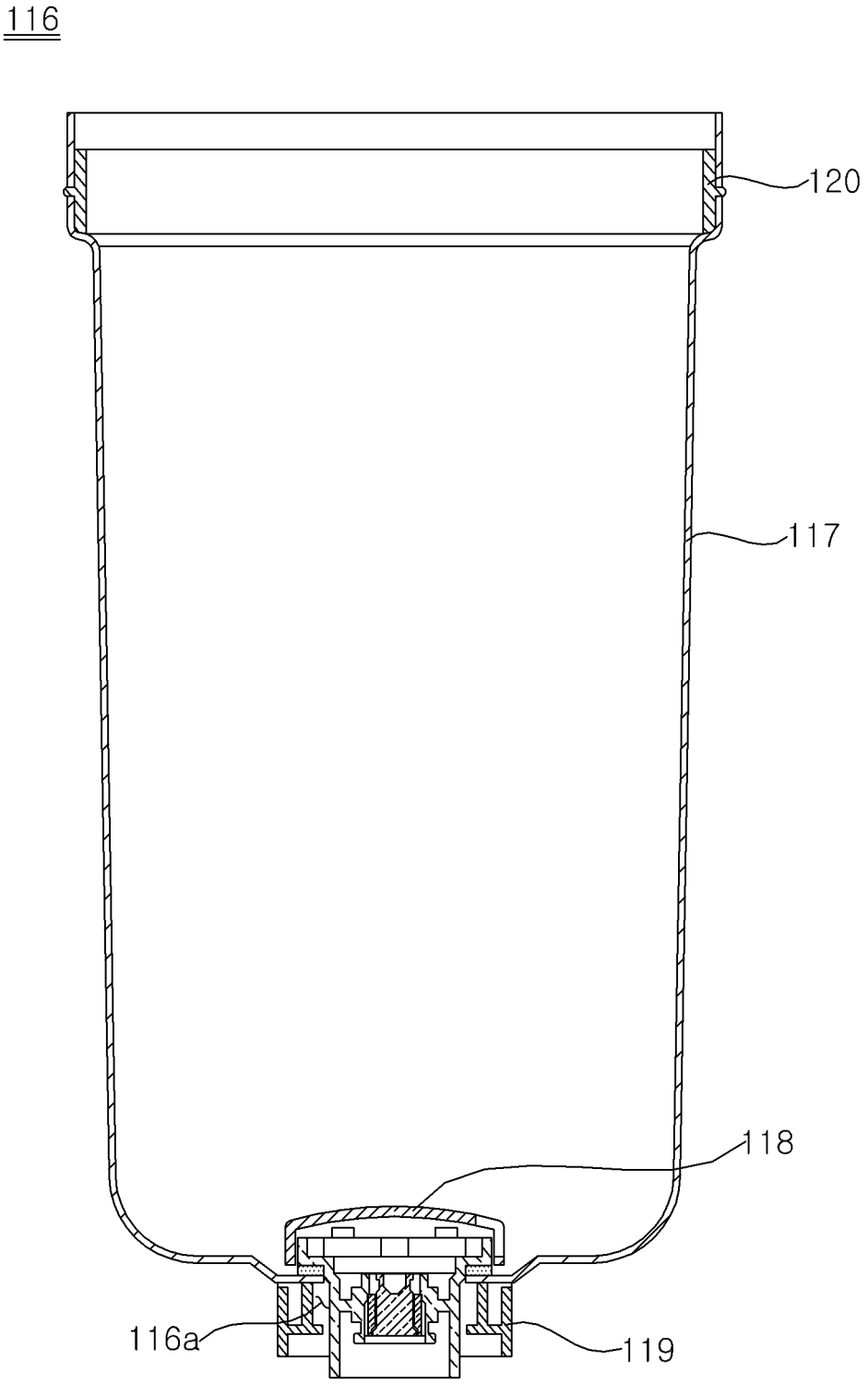
FIG. 10 is a cross-sectional view of one side of FIG. 9.
Figure 11:
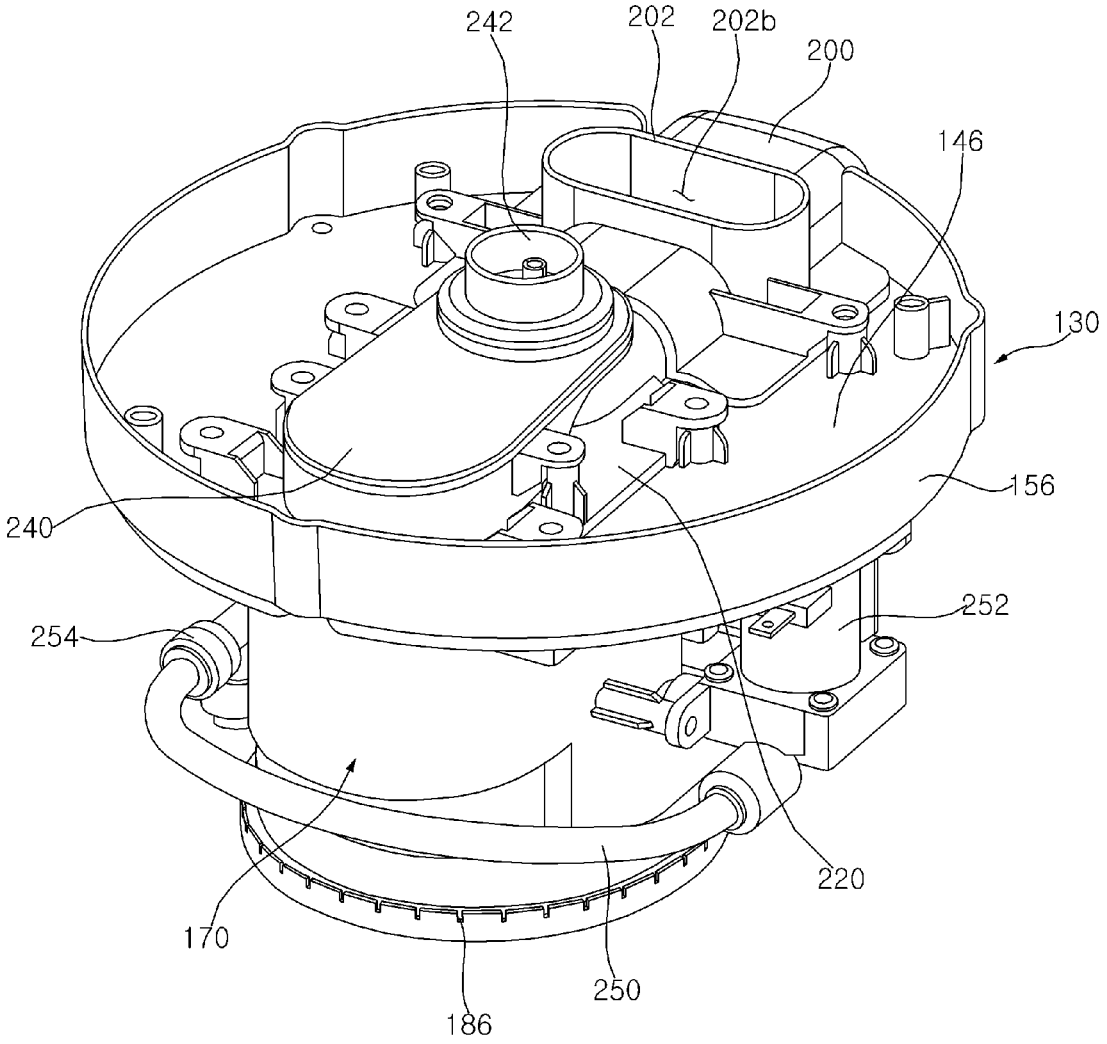
FIG. 11 is a perspective view of a state where a humidifying water tank, a heating water tank, a first connector, a second connector, and a water supply pipe are coupled according to an embodiment of the present disclosure.

Referring to FIG. 10, the inner water tank 116 includes an inner housing 117 that forms a space for storing water therein and has a tank hole 116*a* formed at a lower portion, a cap 118 disposed to open and close the tank hole 116*a*, and a tank connector 119 extending downward around the tank hole 116*a*. The inner water tank 116 may include a handle 120 rotatably connected to the upper side of the inner housing 117.

The cap 118 may be disposed to be movable in the up-down direction inside the tank connector 119.

The inner water tank 116 may move along the outer water tank 112 and may be disposed to be coupled to the water tank connector 242 of the water supply pipe 240.

When the inner water tank 116 is disposed in the upper side of the water supply pipe 240, the cap 118 is disposed in the upper side of the water tank connector 242. A user may move the inner water tank 116 through the handle 120. The handle 120 is rotatably disposed in the inner water tank 116.

Humidifying Water Tank>

Hereinafter, the humidifying water tank of the present disclosure will be described with reference to FIGS. 13 to 15.

The humidifying water tank 130 includes a humidifying water tank wall 132 that forms a space in which water supplied from the heating water tank 170 is stored. The humidifying water tank wall 132 may have a cylindrical structure with an open top and a hollow interior. A humidifying chamber 130*a* may be formed inside the humidifying water tank wall 132.

The ultrasonic oscillator 162*a*, 162*b* may be disposed on the lower surface of the humidifying water tank wall 132 to vibrate and atomize the water stored inside the humidifying water tank wall 132. Two ultrasonic oscillators 162*a*, and 162*b* may be disposed on the lower surface of the humidifying water tank wall 132. The center of each of a pair of ultrasonic oscillators 162*a* and 162*b* may be disposed at a location overlapping a lower hole 202*a* or an upper hole 202*b* of the exhaust pipe 202. Accordingly, the humidified air that is generated by the ultrasonic oscillator 162*a*, 162*b* and flows upward may flow into the exhaust pipe 202.

Figure 13:
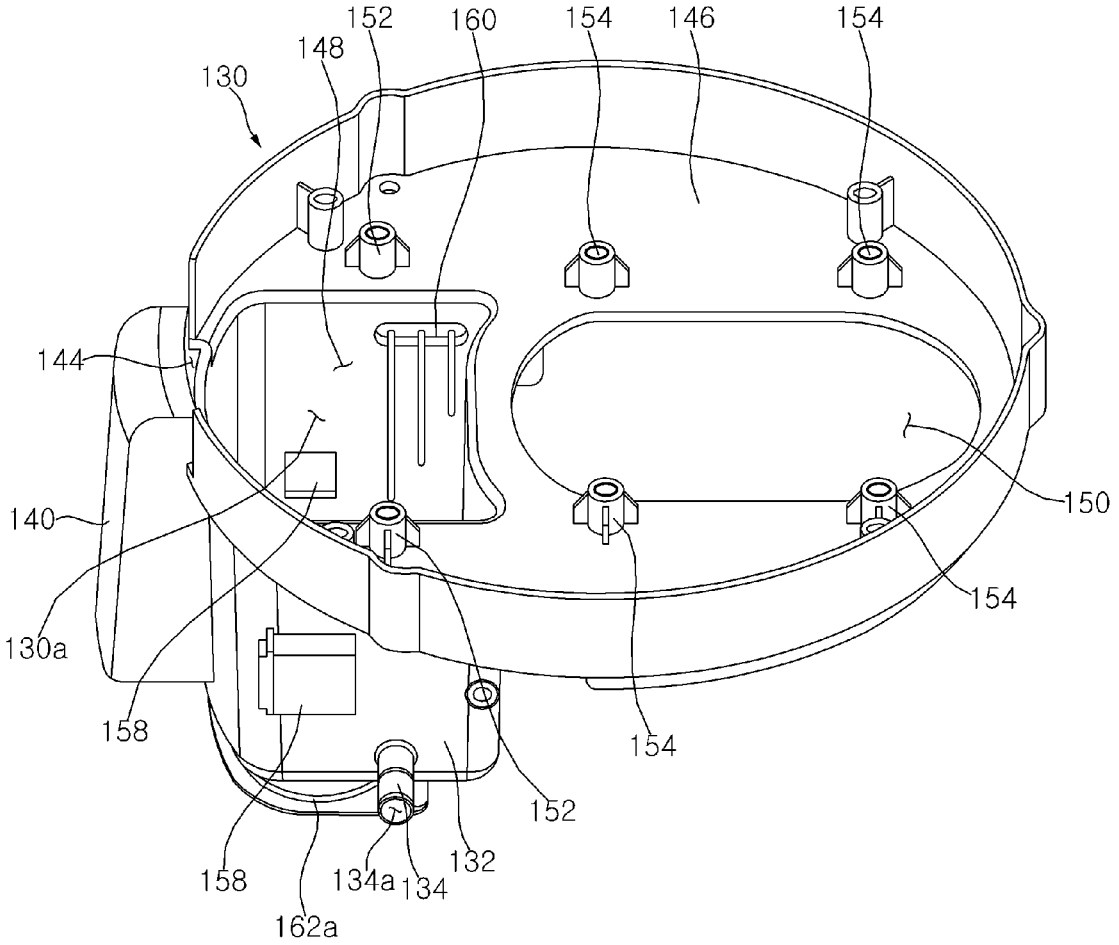
FIG. 13 is a perspective view of a humidifying water tank according to an embodiment of the present disclosure.

Referring to FIG. 13, a water inlet hole 134*a* through which water is supplied to the humidifying water tank 130 is formed in one side of the circumferential surface of the humidifying water tank wall 132. Water stored in the water tank 110 may be supplied into the humidifying water tank 130 through the water inlet hole 134*a*. Water stored in the water tank 110 may be directly supplied to the humidifying water tank 130 through the water inlet hole 134*a*. In addition, water stored in the water tank 110 may be supplied to the humidifying water tank 130 through the water inlet hole 134*a* via the heating water tank 170. In the present disclosure, water heated in the heating water tank 170 is supplied to the humidifying water tank 130 through the water inlet hole 134*a*.

A water inlet pipe 134 protruding outside the circumferential surface of the humidifying water tank wall 132 is disposed around the water inlet hole 134*a*. The water inlet pipe 134 may be connected to the connection pipe 250.

A mounting groove 136 into which an insertion protrusion 176 of the heating water tank 170 described below is inserted may be formed in one side of the upper end of the humidifying water tank wall 132. The mounting groove 136 may be disposed in the opposite direction to an air supply pipe 140.

Figure 14:
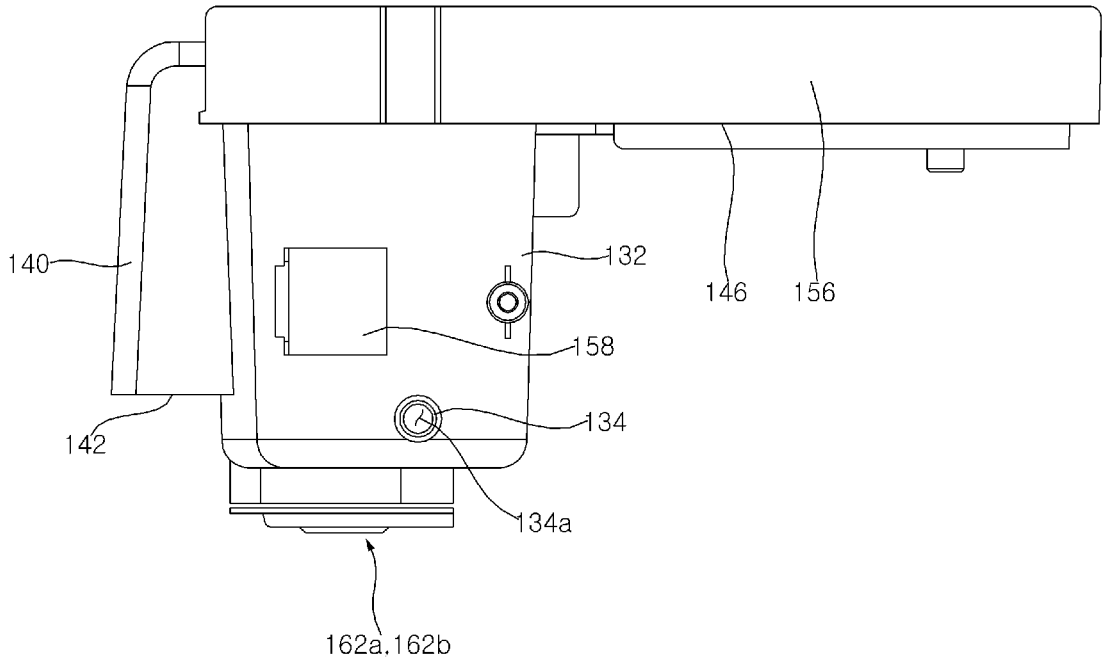
FIG. 14 is a side view of FIG. 13.
Figure 15:
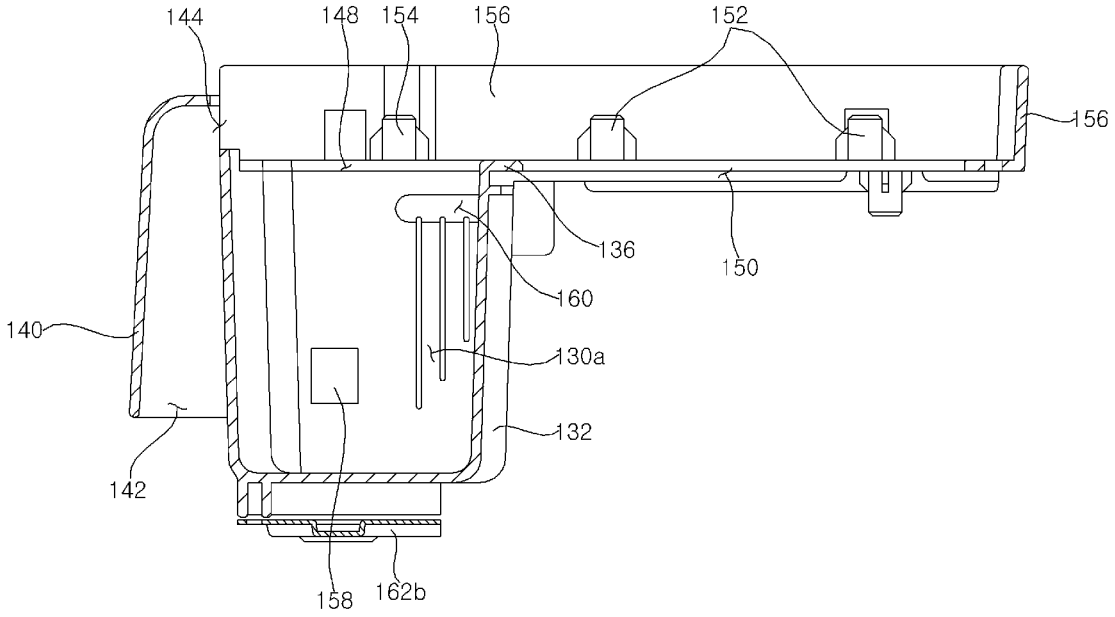
FIG. 15 is a cross-sectional view of one side of FIG. 13.

Referring to FIGS. 13 to 15, in the humidifying water tank 130, the air supply pipe 140 which is disposed around one side of the humidifying water tank wall 132, and through which a portion of the air flowing by the blower 50 is supplied is disposed. In the air supply pipe 140, a supply pipe inlet 142 opened downward and a supply pipe outlet 144 opened to the humidifying chamber 130*a* are formed. The air supply pipe 140 may have a shape in which the cross-sectional area of the passage decreases as it progresses toward the upper side.

Referring to FIG. 15, the supply pipe inlet 142 is formed at the lower end of the air supply pipe 140, and the supply pipe outlet 144 is formed at the upper end of the air supply pipe 140. The supply pipe inlet 142 is opened downward. The supply pipe outlet 144 may be opened in a direction perpendicular to the supply pipe inlet 142.

The supply pipe outlet 144 may be opened from the upper side of the humidifying water tank wall 132 toward the exhaust pipe 202 described below. The supply pipe outlet 144 is disposed at a higher location than the lower hole 202*a* of the exhaust pipe 202.

The air supply pipe 140 may allow a portion of the air flowing upward through the blowing passage 60 to flow into the humidifying chamber 130*a*. The humidified air generated in the humidifying chamber 130*a* may quickly flow upward due to the air flowing through the air supply pipe 140.

Referring to FIG. 13, the humidifying water tank 130 may include an upper plate 146 disposed in the upper side of the humidifying water tank wall 132, and an upper peripheral wall 156 extending upward from the outer circumferential end of the upper plate 146.

The heating water tank 170, the first connector 200, and the second connector 220, which will be described below, may be connected to the humidifying water tank 130 through the upper plate 146.

Referring to FIG. 13, a first hole 148, which is opened to the upper side of the humidifying water tank wall 132, is formed in the upper plate 146. A second hole 150, which is opened upward and downward in the area where the heating chamber 170*a* is disposed, is formed in the upper plate 146.

The first hole 148 is a hole opened to the upper side of the humidifying chamber 130*a*. A first connector 200, which will be described below, may be disposed in the first hole 148.

A heating water tank 170 is disposed in the lower side of the second hole 150. A second connector 220, which will be described below, may be disposed in the upper side of the second hole 150. A first fastening protrusion 152 protruding upward may be formed in the upper surface of the upper plate 146 to be fastened to the first connector 200. A second fastening protrusion 154 protruding upward may be formed in the upper surface of the upper plate 146 to be fastened to the second connector 220.

The upper peripheral wall 156 has a structure extending upward from the outer circumferential end of the upper plate 146. A supply pipe outlet 144 of the air supply pipe 140 is formed in one side of the upper peripheral wall 156. The supply pipe outlet 144 may be formed in the upper side of the upper plate 146.

In the humidifying water tank 130, a sterilizing device 158 may be disposed in one side of the humidifying water tank wall 132. The sterilizing device 158 may be disposed in one side of the humidifying water tank wall 132 and may sterilize water stored inside the humidifying water tank wall 132. Two sterilizing devices 158 that sterilize the inside of the humidifying water tank 130 may be disposed in opposite sides of the humidifying water tank 130 of the present disclosure. The sterilizing device 158 may radiate ultraviolet light into the humidifying water tank wall 132.

A water level sensor 160 may be disposed in the humidifying water tank 130 to detect the level of water stored inside the humidifying water tank 130. The water level sensor 160 may be disposed in one side of the humidifying water tank wall 132.

Heating Water Tank>

Hereinafter, the heating water tank 170 of the present disclosure will be described with reference to FIGS. 16 to 18.

The heating water tank 170 includes a heating water tank wall 171 that stores water.

The heating water tank wall 171 includes an outer water tank wall 172 disposed in the outer circumference. The heating water tank wall 171 includes an inner water tank wall 178 which is disposed inside the outer water tank wall 172, and in which the floating valve 190 is disposed.

Figure 12:
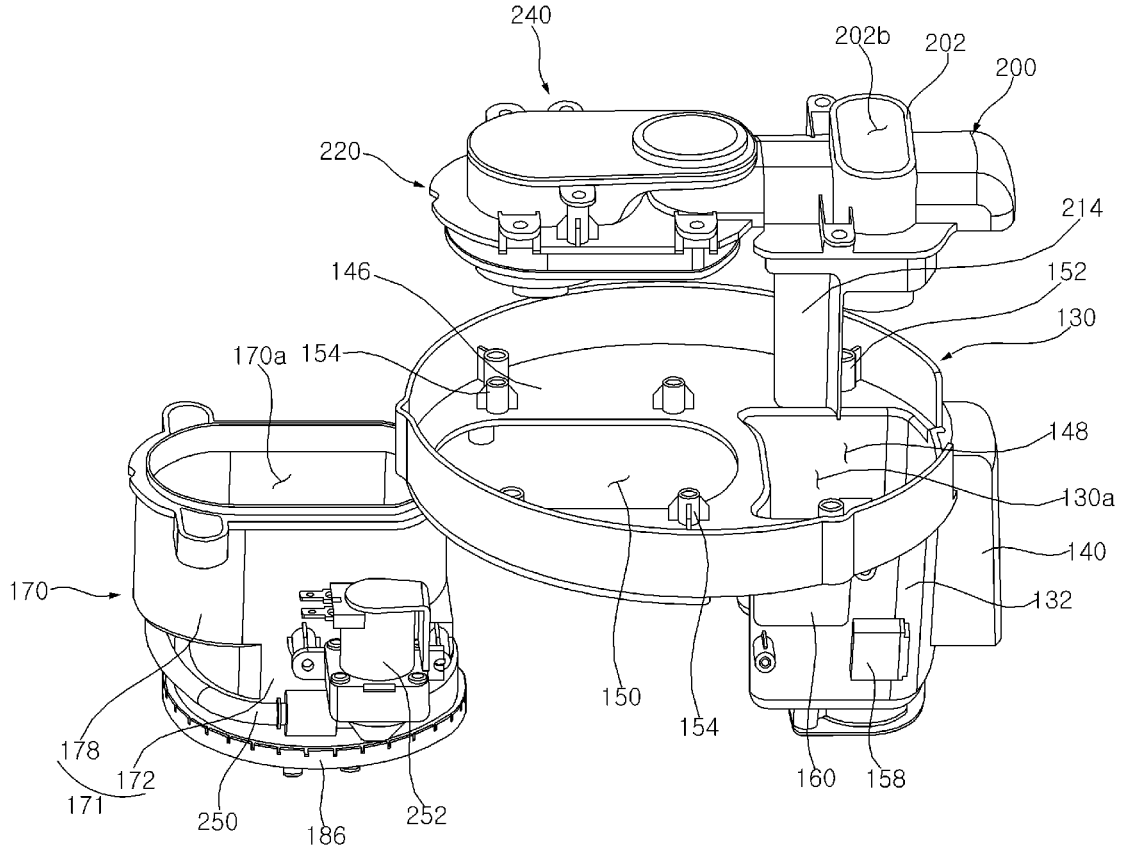
FIG. 12 is an exploded view of FIG. 11.

The outer water tank wall 172 may have a cylindrical shape opened upward so that water can be stored. Referring to FIG. 12, the outer water tank wall 172 may be hollow on the inside and have a cylindrical shape that is opened up and down. A heater 186 is disposed in the lower side of the outer water tank wall 172.

A water discharge hole 174*a* through which water stored in the heating water tank 170 is discharged may be formed on one side of the outer water tank wall 172. A water discharge pipe 174 that protrudes outward around the water discharge hole 174*a* may be formed in one side of the outer water tank wall 172.

The water discharge pipe 174 may be disposed at a higher location than or at the same location as the water inlet pipe 134 formed on the humidifying water tank wall 132. The water discharge pipe 174 may be disposed to be spaced apart upward from the lower end of the heating water tank 170.

Figure 16:
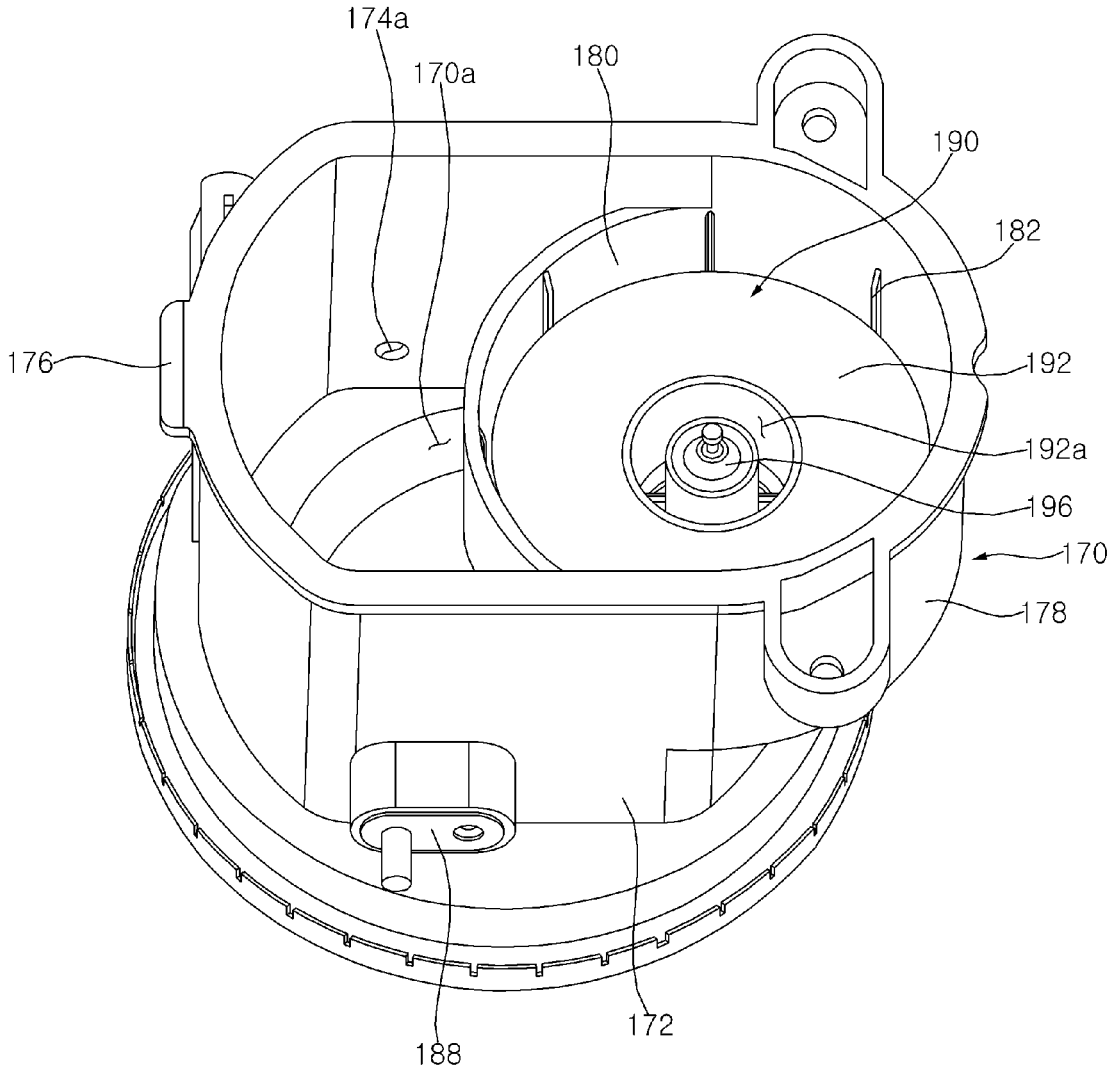
FIG. 16 is a perspective view of a heating water tank according to an embodiment of the present disclosure.
Figure 17:
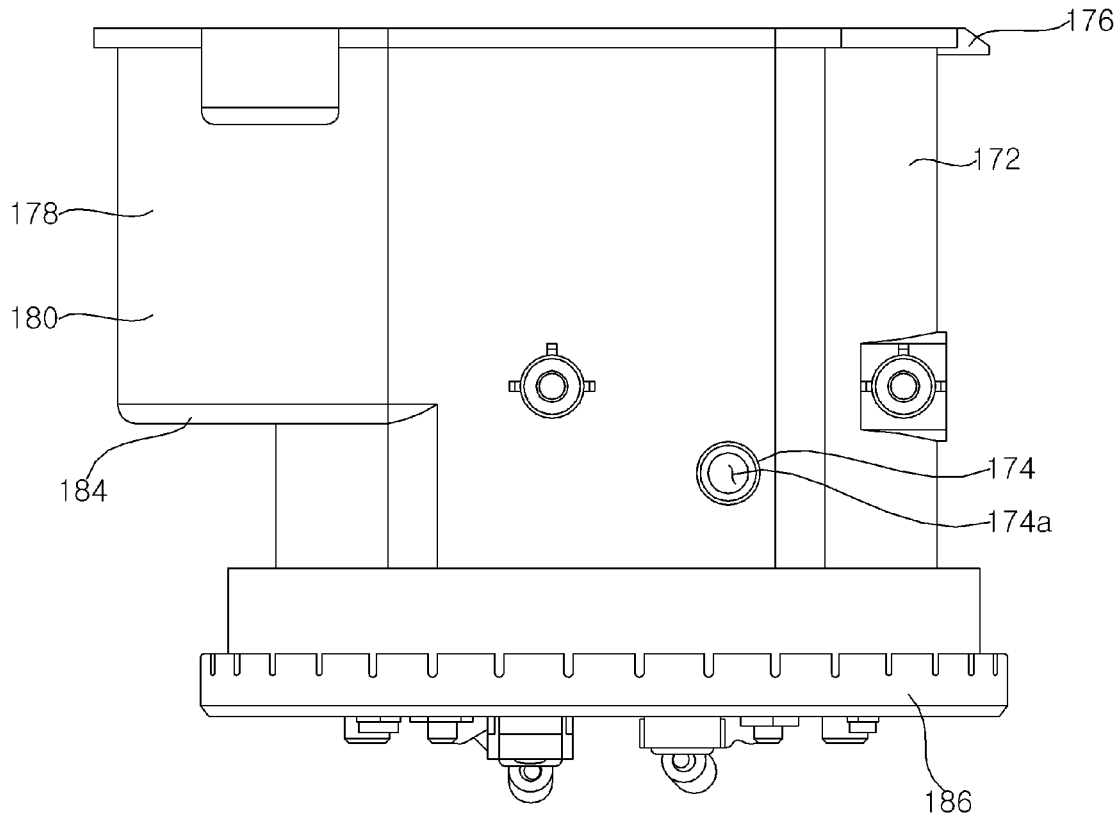
FIG. 17 is a side view of FIG. 16.

Referring to FIG. 16, an insertion protrusion 176 may be disposed in one side of the upper end of the outer water tank wall 172. The insertion protrusion 176 may be inserted into the mounting groove 136 formed in one side of the upper end of the humidifying water tank wall 132.

A temperature sensor 188 that detects the temperature inside the heating chamber 170*a* is disposed in one side of the outer water tank wall 172.

The temperature sensor 188 detects the temperature of water stored inside the heating water tank 170. The temperature sensor 188 is disposed lower than the water discharge pipe 174.

The inner water tank wall 178 is disposed inside the outer water tank wall 172. One circumferential surface of the inner water tank wall 178 may be disposed to overlap one circumferential surface of the outer water tank wall 172. The inner water tank wall 178 includes an inner peripheral wall 180 protruding to the inside of the outer water tank wall 172 and an inner lower wall 184 that restricts downward movement of the floating valve 190.

An inner rib 182 protruding to the inner side where the floating valve 190 is disposed is disposed in the inside of the inner peripheral wall 180. The inner rib 182 may space the floating valve 190 from the inner peripheral wall 180 by a certain distance. In addition, the inner rib 182 may prevent the floating valve 190 disposed inside the inner peripheral wall 180 from rotating in the circumferential direction.

A plurality of inner ribs 182 spaced apart in the circumferential direction may be disposed on the inner circumferential surface of the inner peripheral wall 180. The inner rib 182 may have a structure extending in the up-down direction from the inner circumferential surface of the inner peripheral wall 180.

The upper side of the inner peripheral wall 180 is opened, and the inner lower wall 184 is disposed in the lower side of the inner peripheral wall 180. The upper end of the inner peripheral wall 180 may be disposed lower than the upper end of the outer water tank wall 172. The lower end of the inner peripheral wall 180 may be disposed higher than the lower end of the outer water tank wall 172.

Figure 18:
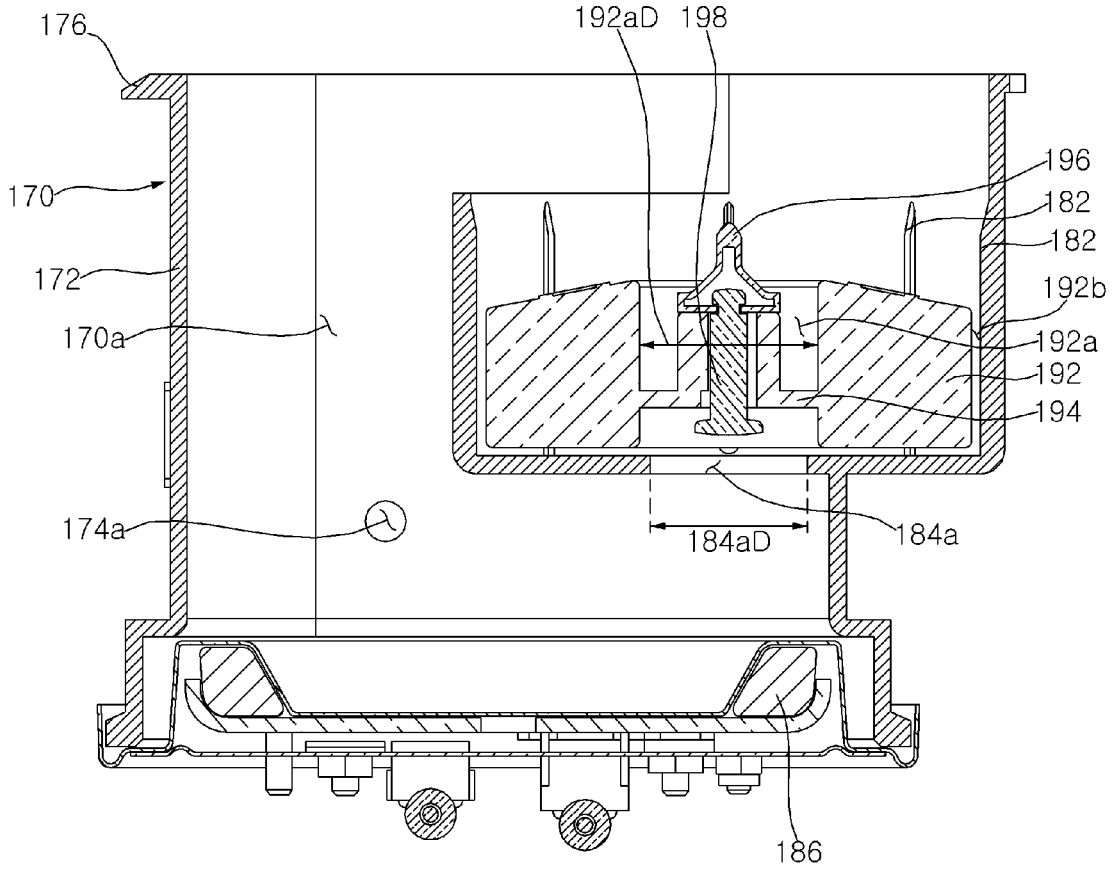
FIG. 18 is a cross-sectional view of one side of FIG. 16.
Figure 19:
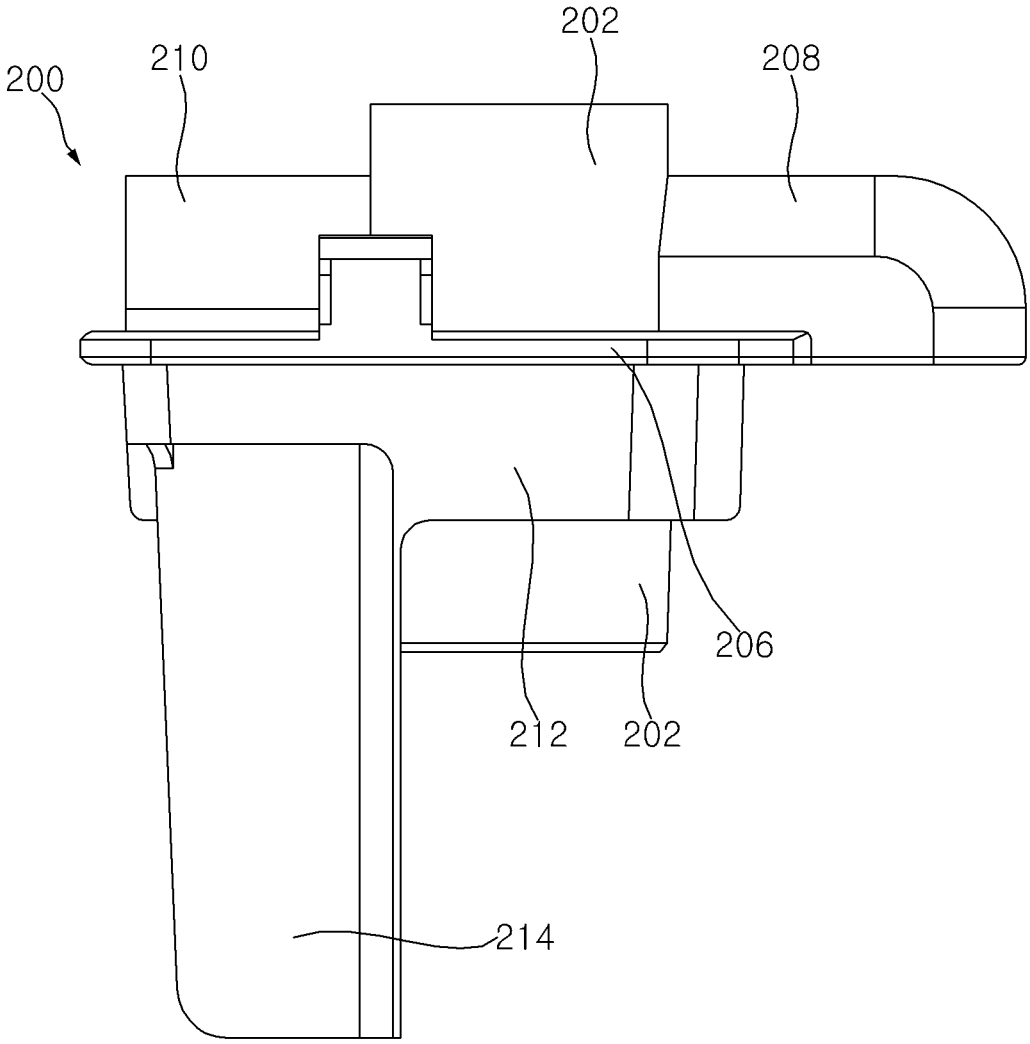
FIG. 19 is a side view of a first connector according to an embodiment of the present disclosure.
Figure 20:
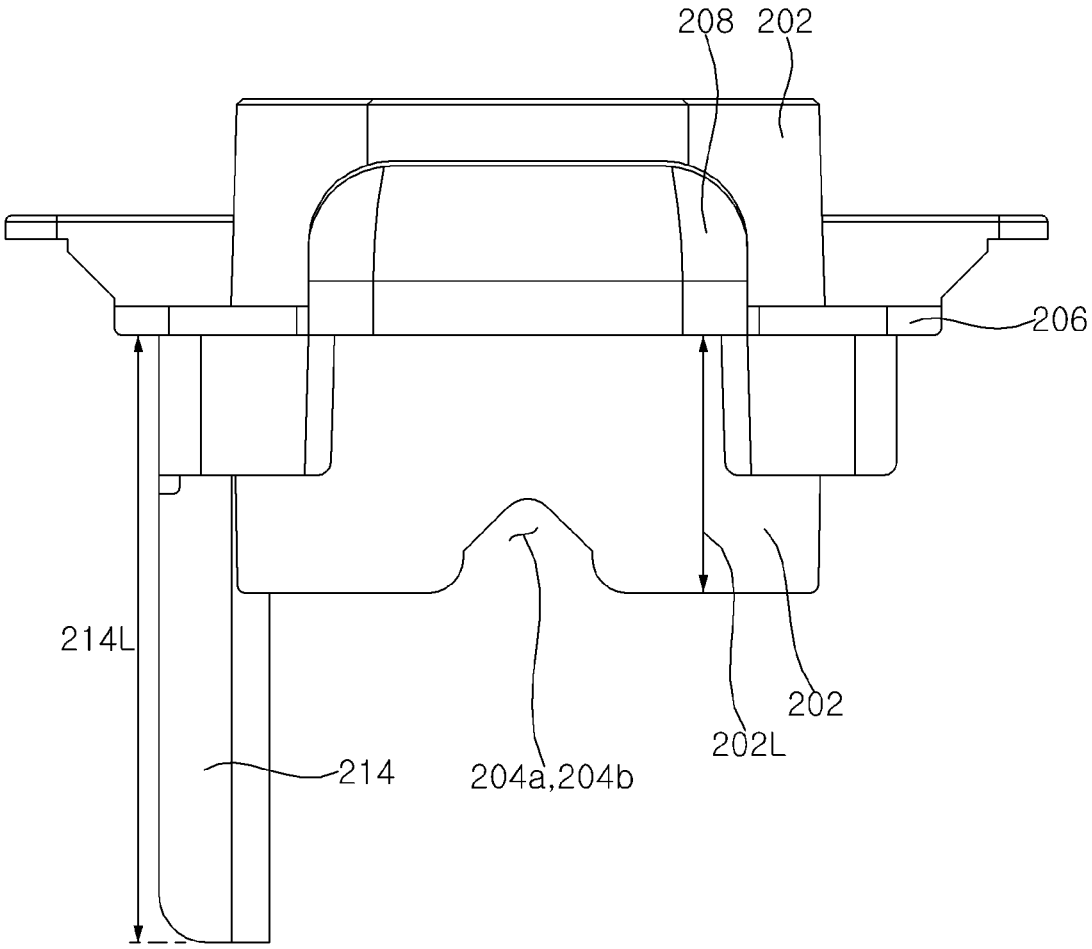
FIG. 20 is a front view of FIG. 19.
Figure 21:
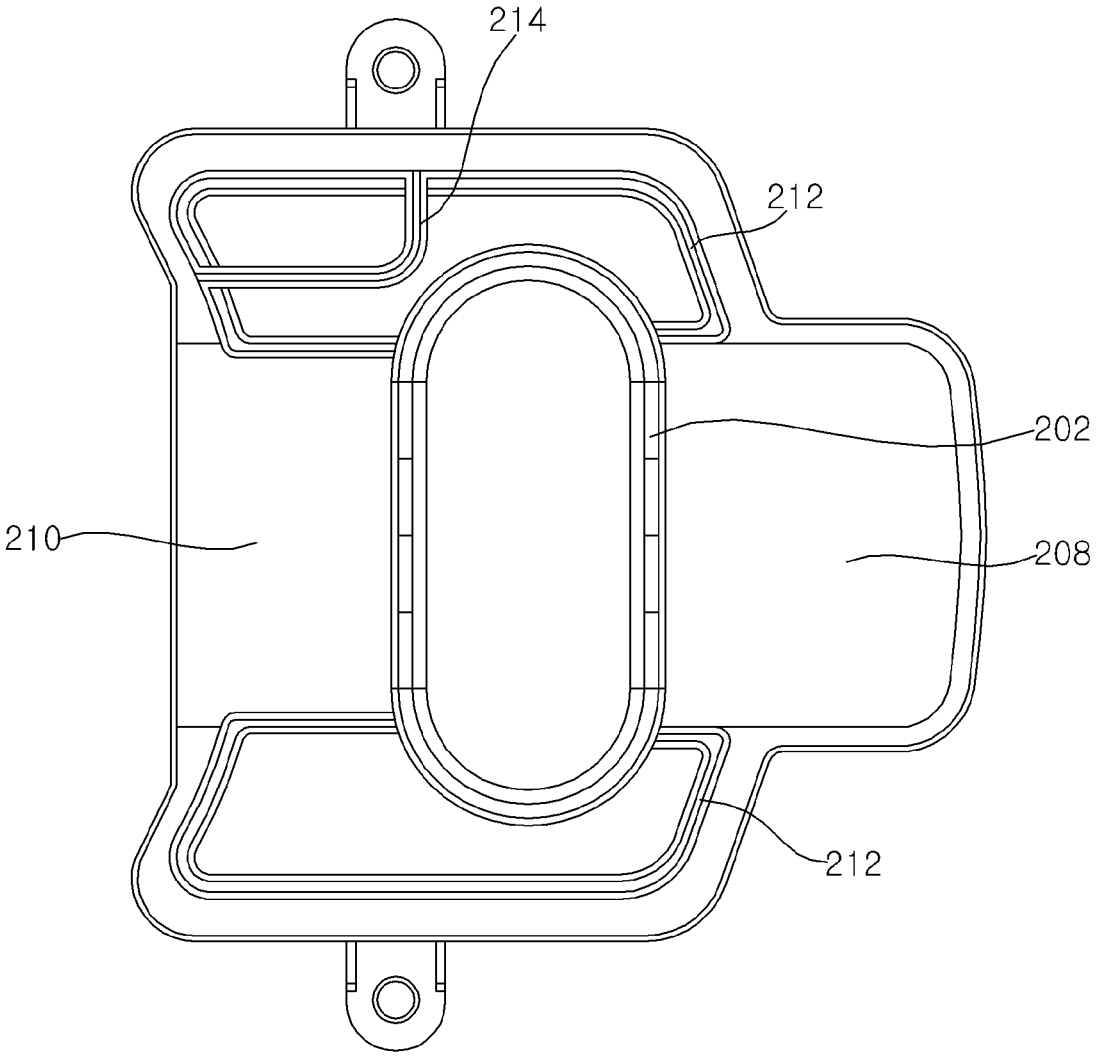
FIG. 21 is a bottom view of FIG. 19.
Figure 22:
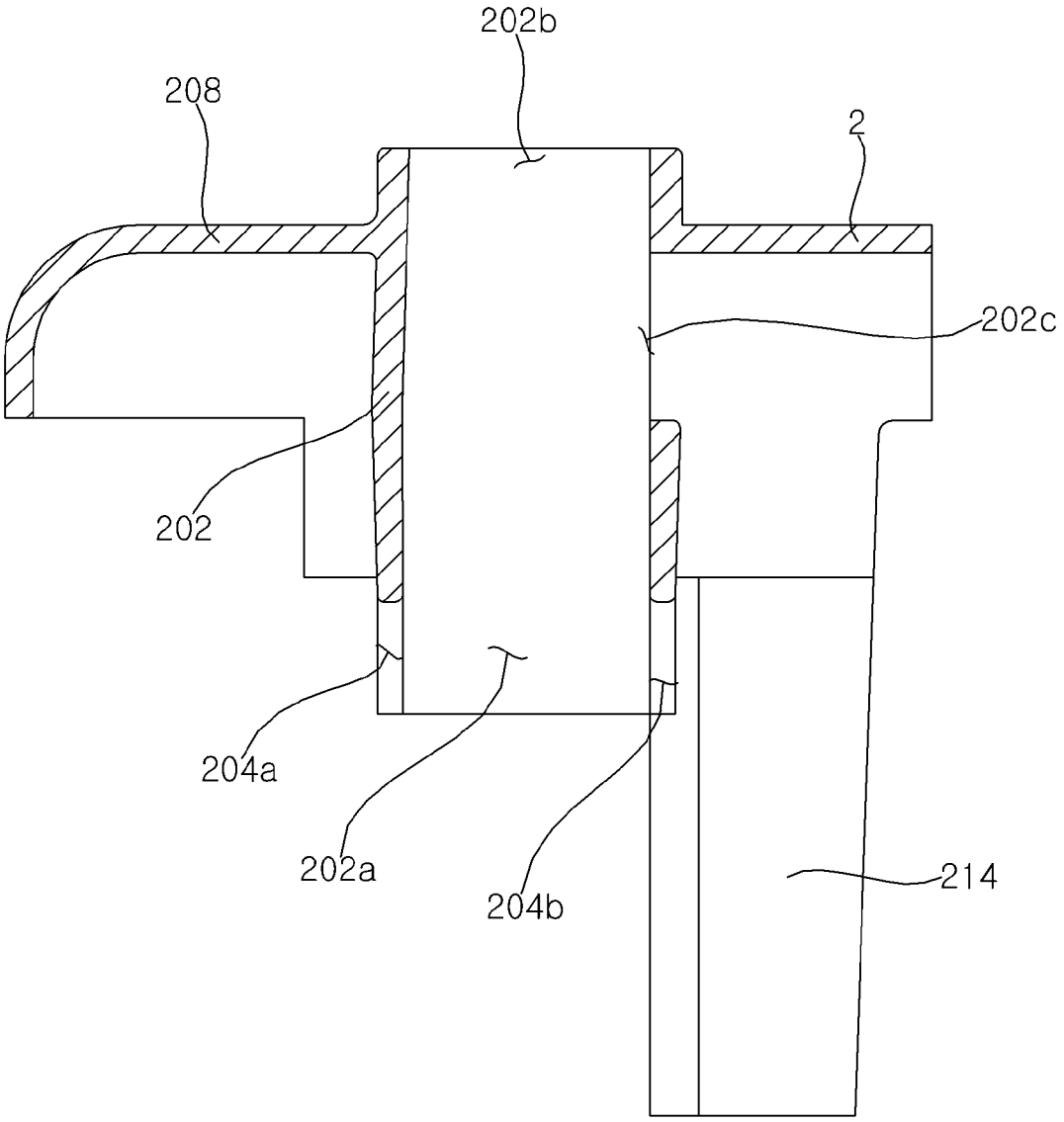
FIG. 22 is a cross-sectional view of one side of FIG. 19.

Referring to FIG. 18, a communication hole 184*a* is formed in the center of the inner lower wall 184. The communication hole 184*a* communicates the inside of the inner water tank wall 178 and the inside of the outer water tank wall 172. Water flowing into the inner water tank wall 178 through the communication hole 184*a* may be supplied to the outer water tank wall 172.

The center of the inner water tank wall 178 may be formed differently from the center of the outer water tank wall 172. Here, the center of the inner water tank wall 178 may mean the center of the inner lower wall 184 where the floating valve 190 is disposed. In addition, the center of the outer water tank wall 172 may mean the center of the area where the heater 186 is disposed.

The floating valve 190 may be disposed inside the inner water tank wall 178. The height of the floating valve 190 may vary depending on the amount of water stored in the outer water tank wall 172. The floating valve 190 may open and close a water supply hole 222*a* of the second connector 220 described below depending on the height.

The floating valve 190 may be disposed inside the heating water tank 170 to adjust the water level inside the heating water tank 170. The floating valve 190 may be disposed inside the heating water tank 170 to adjust the water level of the humidifying water tank 130. The water level of the humidifying water tank 130 is adjusted according to the dislocation of the floating valve 190. The floating valve 190 is disposed in the upper side of the connection pipe 250.

The floating valve 190 is disposed to be movable up and down inside the inner water tank wall 178. The floating valve 190 has a water discharge hole 174*a* or a water inlet hole 134*a* located lower than the lowest location inside the inner water tank wall 178.

The floating valve 190 may be located lower than the lower end of the exhaust pipe 202, at the highest location inside the inner water tank wall 178. Accordingly, even if the water level is formed at the highest location inside the humidifying water tank 130, the water level inside the humidifying water tank 130 may be formed lower than the lower end of the exhaust pipe 202. When the floating valve 190 is located at the upper end, the water level stored in the humidifying water tank 130 may be formed lower than the lower end of the exhaust pipe 202.

Referring to FIG. 18, the floating valve 190 includes a valve body 192 formed of a material that floats on water, a valve stopper 196 that is disposed inside the valve body 192 and opens and closes the water supply hole 222*a* of the second connector 220 described below, and a stopper pillar 198 that is connected to the valve stopper 196 and extends downward.

The valve body 192 has a ring shape, and has a central hole 192*a* formed in the inside. The central hole 192*a* may have a shape that penetrates the center of the valve body 192. The diameter 192*a*D of the central hole 192*a* may be greater than or equal to the diameter 184*a*D of the communication hole 184*a*. Therefore, even if bubbles generated from water heated inside the outer water tank wall 172 flows into the inner water tank wall 178 through the communication hole 184*a*, they may flow to the inside of the central hole 192*a* to minimize the impact on the up-down movement of the floating valve 190.

A guide groove 192*b* corresponding to the inner rib 182 disposed on the inner circumferential surface of the inner water tank wall 178 may be formed on the circumferential surface of the valve body 192. The guide groove 192*b* may be formed to extend in the up-down direction. A plurality of guide grooves 192*b* may be disposed to be spaced apart in the circumferential direction on the outer circumferential surface of the valve body 192.

A connecting rib 194 connected to the stopper pillar 198 is disposed on the inner circumferential surface of the valve body 192. The connecting rib 194 may have a structure that protrudes inward in a radial direction from the inner circumferential surface of the valve body 192 and is connected to the stopper pillar.

The valve stopper 196 may have a structure whose diameter decreases toward the upper side. The valve stopper 196 may have a sharp upper side. The valve stopper 196 may have a cylindrical shape with a sharp upper side. The upper end of the valve stopper 196 may be disposed higher than the upper end of the valve body 192.

First Connector>

Hereinafter, a first connector according to an embodiment of the present disclosure will be described with reference to FIGS. 19 to 22.

The first connector 200 is connected to the upper side of the humidifying water tank 130. The first connector 200 may supply humidified air generated in the humidifying water tank 130 to a first discharge passage 74 described below. The first connector 200 may communicate the inside of the humidifying water tank 130 and the first discharge passage 74.

The first connector 200 may supply air introduced from the heating water tank 170 to the first discharge passage 74. The first connector 200 may supply air introduced through the air supply pipe 140 to the first discharge passage 74.

The first connector 200 includes an exhaust pipe 202 that communicates the humidifying chamber 130*a* and the first discharge passage 74. The exhaust pipe 202 has a structure that extends vertically. The lower end of the exhaust pipe 202 is disposed inside the humidifying chamber 130*a*. The upper end of the exhaust pipe 202 is connected to the bottom wall 78.

The exhaust pipe 202 may have an oval cross-sectional shape. The exhaust pipe 202 may have an oval pillar shape formed long in the direction in which the two ultrasonic oscillators 162*a* and 162*b* disposed on the lower surface of the humidifying water tank wall 132 are spaced apart. Therefore, humidified air generated by the ultrasonic oscillators 162*a* and 162*b* can easily flow into the lower hole 202*a* of the exhaust pipe 202.

A first groove 204*a*, which is recessed upward in the direction in which the air supply pipe 140 is disposed, is formed in the lower end of the exhaust pipe 202. A second groove 204*b*, which is recessed upward in the direction in which the heating water tank 170 is disposed, is formed in the lower end of the exhaust pipe 202.

The first groove 204*a* and the second groove 204*b* may allow the air discharged from the air supply pipe 140 to easily flow into the exhaust pipe 202. The first groove 204*a* and the second groove 204*b* may allow humidified air discharged from the heating water tank 170 to easily flow into the exhaust pipe 202.

The first groove 204*a* and the second groove 204*b* may allow air flowing from the air supply pipe 140 to flow into the exhaust pipe 202, even if the humidifying water tank 130 is filled with water at a certain level. The first groove 204*a* and the second groove 204*b* may allow air flowing from the air flow pipe 230 to flow into the exhaust pipe 202, even if the humidifying water tank 130 is filled with water at a certain level. The first groove 204*a* and the second groove 204*b* are disposed in opposite directions.

The lower hole 202*a* is formed in the lower end of the exhaust pipe 202, and the upper hole 202*b* is formed in the upper end. Accordingly, humidified air generated in the humidifying chamber 130*a* may flow into the lower hole 202*a* and flow into the upper hole 202*b*. In the case of humidified air, due to its rising nature, it may flow from the lower hole 202*a* to the upper hole 202*b* and flow into the first discharge passage 74. However, condensed water generated in the first discharge passage 74 may flow into the upper hole 202*b* of the exhaust pipe 202 and flow into the lower hole 202*a*. Accordingly, condensed water generated in the first discharge passage 74 may flow into the humidifying chamber 130*a*.

A middle hole 202*c* may be formed in the exhaust pipe 202, in one side facing a flow pipe outlet 234 of the air flow pipe 230 of the second connector 220 described below. The middle hole 202*c* is disposed between the lower hole 202*a* and the upper hole 202*b*. The middle hole 202*c* may be disposed in the area where the humidifying chamber 130*a* is formed. The middle hole 202*c* may be disposed to face the flow pipe outlet 234 of the air flow pipe 230. Accordingly, the air flowing in the heating water tank 170 through the air flow pipe 230 may flow into the exhaust pipe 202 through the middle hole 202*c*. Water vapor discharged from the heating chamber 170*a* through the air flow pipe 230 may flow to the exhaust pipe 202 through the middle hole 202*c* or the lower hole 202*a* and then flow into the first discharge passage 74.

The first connector 200 includes a first plate 206 disposed in the upper side of the upper plate 146 of the humidifying water tank 130. The first plate 206 is disposed in the upper side of the upper plate 146. The upper plate 146 extends in a direction perpendicular to the up-down direction in which the exhaust pipe 202 extends. The first plate 206 may be disposed to be seated on the upper side of the upper plate 146. With the first plate 206 seated on the upper plate 146, the first connector 200 may be fastened to the humidifying water tank 130.

The first connector 200 includes a first connecting plate 208 disposed in the upper side of the air supply pipe 140. The first connecting plate 208 may have a shape bent upward from the first plate 206. The first connecting plate 208 may have a shape corresponding to the upper side of the air supply pipe 140.

Accordingly, the air flowing through the air supply pipe 140 may flow into the inner space of the humidifying water tank wall 132 along the first connecting plate 208. However, the air supplied through the air supply pipe 140 may flow downward inside the humidifying water tank wall 132 through the exhaust pipe 202 and flow to the exhaust pipe 202. That is, the air supplied through the air supply pipe 140 may flow inside the humidifying water tank wall 132 and flow to the exhaust pipe 202 together with the humidified air generated inside the humidifying water tank 130. This may increase the amount of humidified air flowing through the exhaust pipe 202.

The first connector 200 includes a second connecting plate 210 disposed in the upper side of the air flow pipe 230 of the second connector 220 described below. The second connecting plate 210 may have a shape bent upward from the first plate 206. The second connecting plate 210 may have a shape corresponding to the upper surface of the air flow pipe 230.

Accordingly, the air flowing through the air flow pipe 230 may flow into the inner space of the humidifying water tank wall 132 along the second connecting plate 210. The air supplied through the air flow pipe 230 may flow into the middle hole 202*c* of the exhaust pipe 202. In addition, the air supplied through the air flow pipe 230 may flow inside the humidifying chamber 130*a* and flow into the lower hole 202*a* of the exhaust pipe 202.

The supply pipe outlet 144 of the air supply pipe 140 and the flow pipe outlet 234 of the air flow pipe 230 may be disposed in opposite directions with respect to the exhaust pipe 202.

The first connector 200 includes a lower protrusion 212 that protrudes downward from the first plate 206, and is mounted in the inside of the humidifying water tank wall 132. The lower protrusion 212 may have a structure that protrudes downward from the first plate 206. The lower protrusion 212 may be disposed in contact with the humidifying water tank wall 132 of the humidifying water tank 130. The lower protrusion 212 contacts the inside of the humidifying water tank wall 132, so that the disposition of the first connector 200 disposed in the upper side of the humidifying water tank 130 can be fixed.

The first connector 200 may include a blocking wall 214. The blocking wall 214 extends downward from the first plate 206. The blocking wall 214 may be disposed in the area where the water level sensor 160 is disposed. The blocking wall 214 has a bending structure, and has one end and the other end that are disposed in contact with the inside of the humidifying water tank wall 132.

The length 214L of the blocking wall 214 protruding downward from the first plate 206 may be longer than the length 202L of the exhaust pipe 202 protruding downward from the first plate 206. Accordingly, the blocking wall 214 may minimize changes in the water level vibrated by the ultrasonic vibrator 162*a*, 162*b* in the area where the water level sensor 160 is disposed.

Second Connector>

Figure 23:
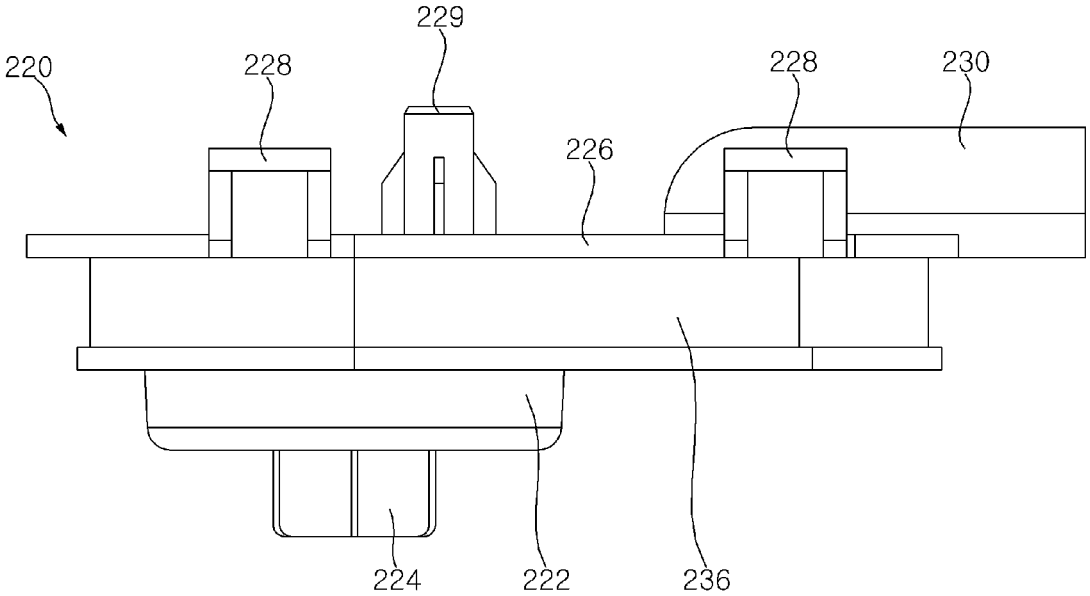
FIG. 23 is a side view of a second connector according to an embodiment of the present disclosure.
Figure 24:
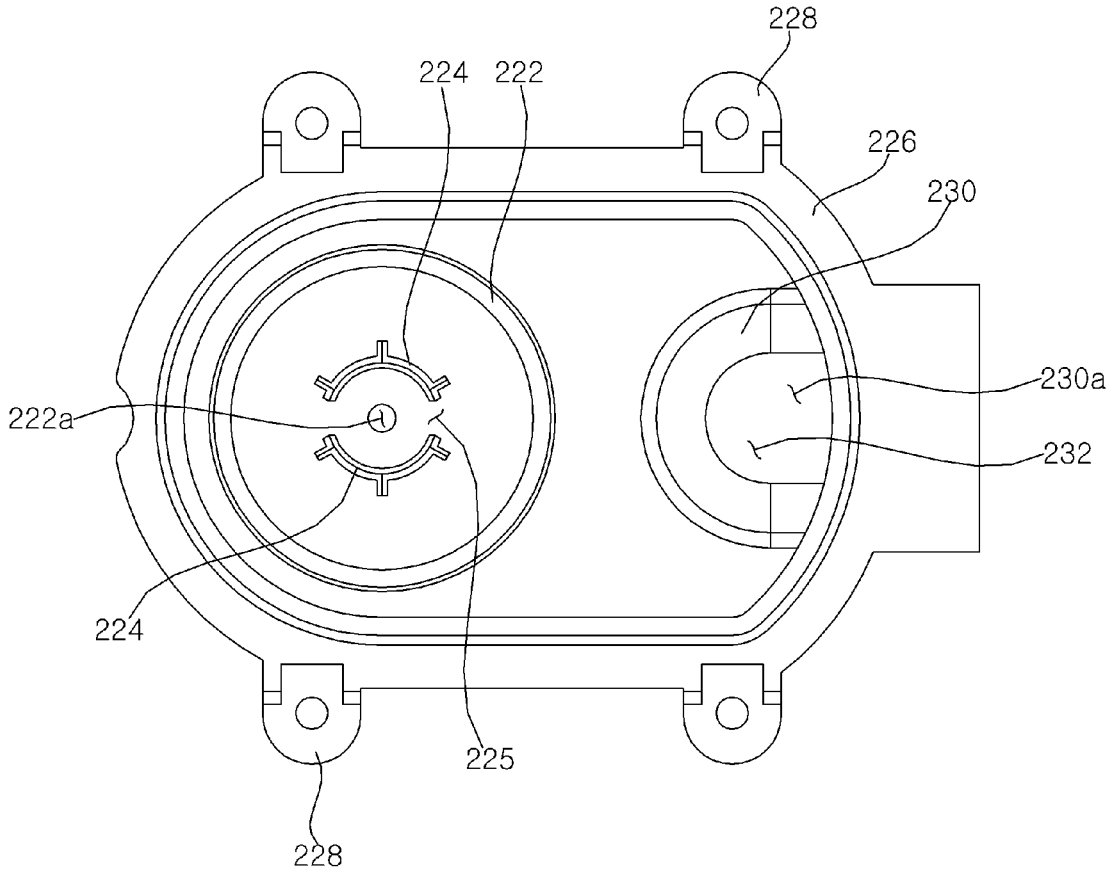
FIG. 24 is a bottom view of FIG. 23.
Figure 25:
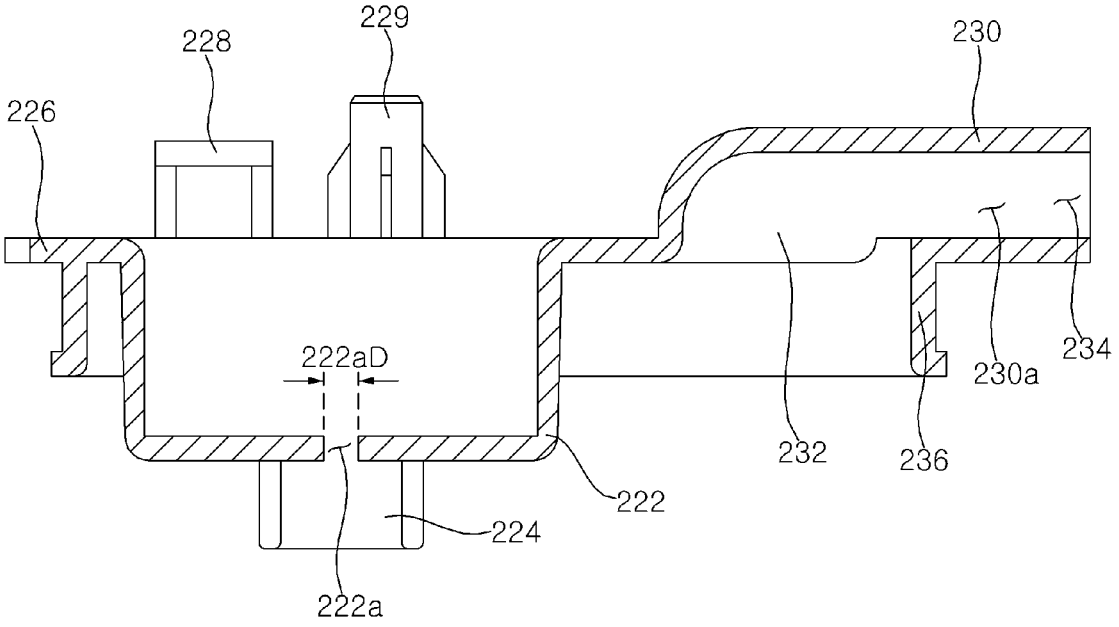
FIG. 25 is a cross-sectional view of one side of FIG. 23.

Hereinafter, a second connector according to an embodiment of the present disclosure will be described with reference to FIGS. 23 to 25.

The second connector 220 may cover the upper side of the heating water tank 170. The second connector 220 may supply water vapor generated in the heating water tank 170 into the humidifying water tank 130. The second connector 220 may supply water discharged from the water tank 110 to the heating water tank 170.

The second connector 220 has the water supply hole 222*a* through which water supplied from the water supply pipe 240 described below is supplied to the heating water tank 170. The water supply hole 222*a* is disposed in the upper side of the inner water tank wall 178 of the heating water tank 170.

The second connector 220 includes a water supply tank 222 that temporarily stores water supplied from the water supply pipe 240 described below and supplies it to the heating water tank 170. The water supply tank 222 is disposed in the upper side of the inner water tank wall 178. The water supply hole 222*a*, which supplies water supplied from the water supply pipe 240 into the inner water tank wall 178, is formed in the water supply tank 222.

The second connector 220 includes a second plate 226 disposed in the upper side of the upper plate 146. The second plate 226 is disposed in the upper side of the upper plate 146 to seat the second connector 220 in the humidifying water tank 130. The second connector 220 may be fastened by a separate fastening means while the second plate 226 is mounted on the upper plate 146.

The water supply tank 222 may have a shape that is concave downward from the second plate 226. The water supply tank 222 may have a cylindrical shape that is recessed downward from the second plate 226. The diameter 222D of the internal space formed by the water supply tank 222 may be smaller than the diameter 178D of the internal space formed by the inner water tank wall 178.

The lower end of the water supply tank 222 is disposed lower than the upper end of the inner water tank wall 178.

The diameter 222*a*D formed by the water supply hole 222*a* may be smaller than the diameter 184*a*D of the communication hole 184*a* formed on the lower surface of the inner water tank wall 178. The diameter 222*a*D formed by the water supply hole 222*a* may be smaller than the diameter 192*a*D of the central hole 192*a* formed in the floating valve 190. The water supply hole 222*a* may be disposed above the communication hole 184*a*. The water supply hole 222*a* may be formed above the central hole 192*a*. Therefore, the water flowing into the inner water tank wall 178 through the water supply hole 222*a* may flow to the inner space of the outer water tank wall 172 through the center hole 192*a* of the floating valve 190 and the communication hole 184*a* of the inner water tank wall 178.

A guide protrusion 224 is formed on the lower surface of the water supply tank 222 to protrude downward. A pair of guide protrusions 224 in which semicircular structures are disposed spaced apart from each other may be disposed on the lower surface of the water supply tank 222. A pair of guide protrusions 224 are spaced apart from each other to form a gap 225. Water may be discharged through the gap formed between the pair of guide protrusions 224.

The valve stopper 196 of the floating valve 190 may be disposed inside the guide protrusion 224. The guide protrusion 224 can prevent the valve stopper 196 from vibrating in a direction perpendicular to the up-down direction when it moves up and down. The water supply hole 222*a* is formed inside the guide protrusion 224.

At least a portion of the guide protrusion 224 may be located in the central hole 192*a* formed inside the valve body 192.

The second connector 220 includes an air flow pipe 230 that sends water vapor generated inside the heating chamber 170*a* to the humidifying chamber 130*a*.

The air flow pipe 230 protrudes upward from the second plate 226, and has a structure extending in the direction in which the humidifying chamber 130*a* is disposed. The air flow pipe 230 includes a flow pipe inlet 232 (or "first end hole") through which air inside the heating chamber 170*a* flows, and a flow pipe outlet 234 (or "second end hole") through which air flows inside the air flow pipe 230 flows into the humidifying chamber 130*a*.

Figure 29:
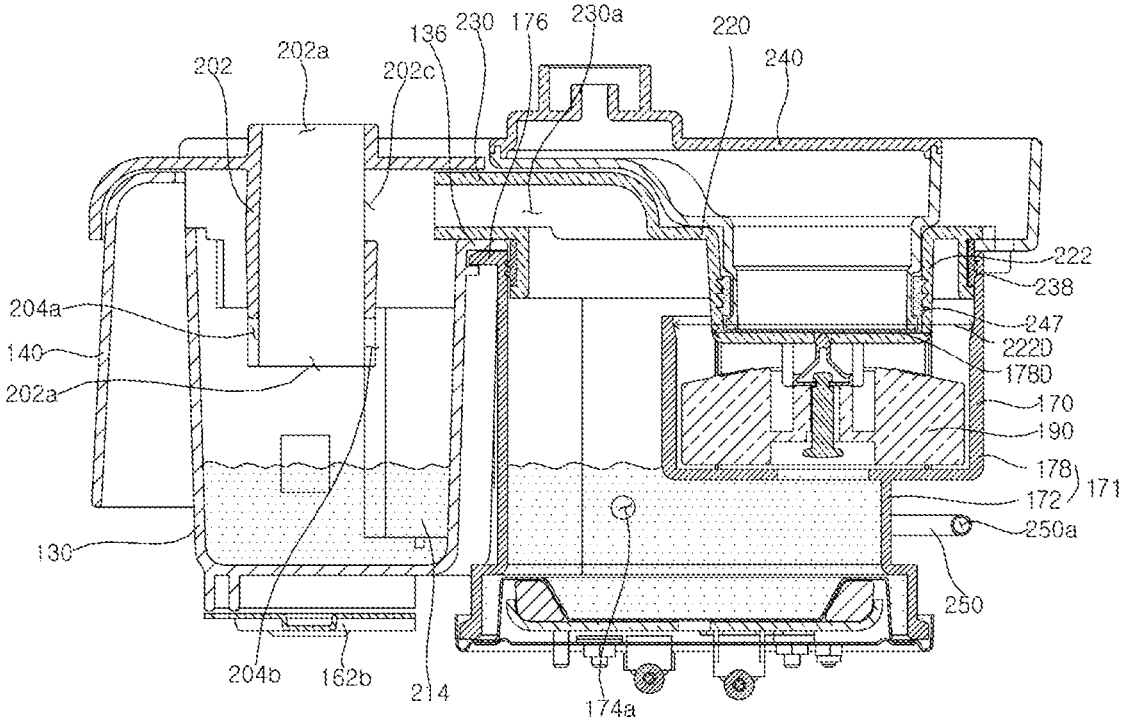
FIG. 29 is a cross-sectional view of one side of FIG. 28.
Figure 30:
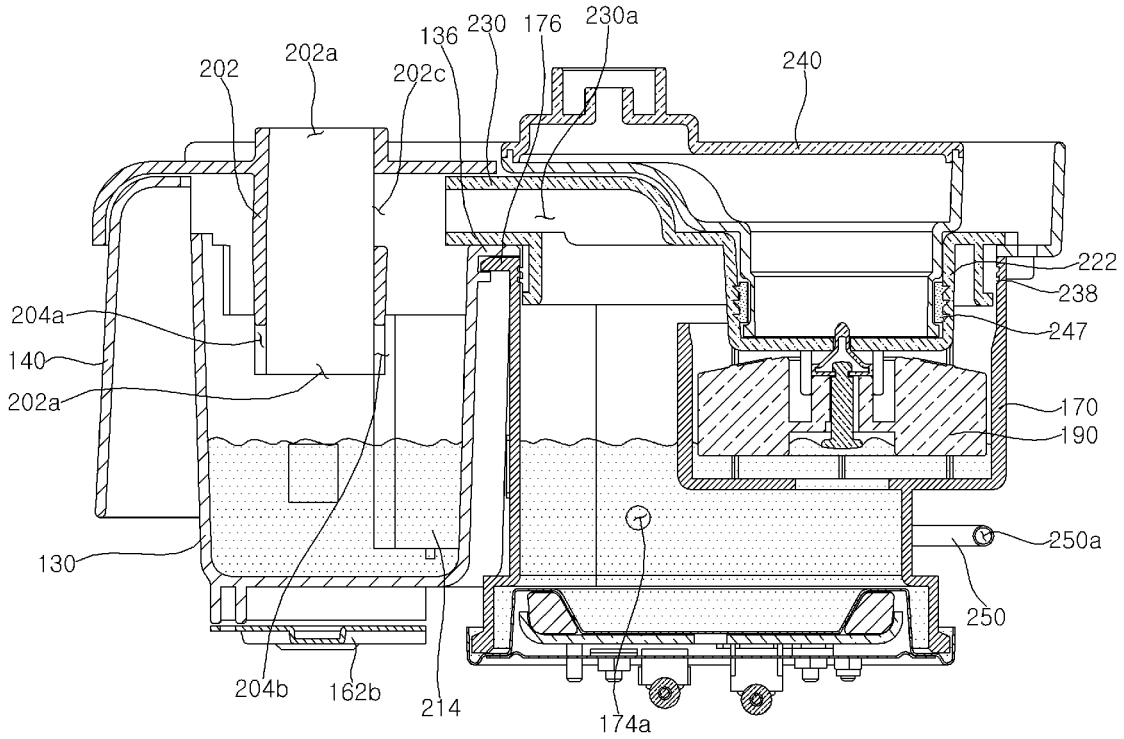
FIG. 30 is a diagram showing the raised water levels in a humidifying water tank and a heating water tank in FIG. 29.
Figure 31:
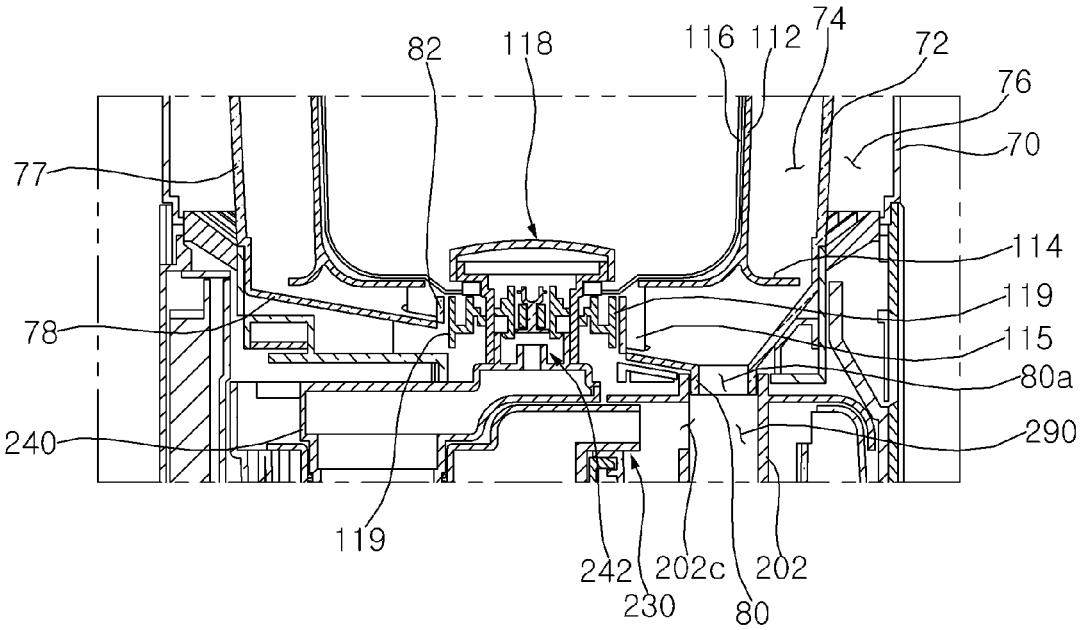
FIG. 31 is a partial cross-sectional view for explaining the disposition of a bottom wall and a lower area of water tank according to an embodiment of the present disclosure.

The flow pipe inlet 232 of the air flow pipe 230 is formed to be opened in the up-down direction. The flow pipe outlet 234 of the air flow pipe 230 is opened in a direction perpendicular to the flow pipe inlet 232. The flow pipe outlet 234 is opened toward the exhaust pipe 202 disposed inside the humidifying chamber 130*a*. Referring to FIG. 29, the flow pipe inlet 232 may be disposed not to overlap the inner water tank wall 178 in the up-down direction. That is, the flow pipe inlet 232 may be disposed in the upper side of an area excluding an area where the inner water tank wall 178 is disposed.

The second connector 220 includes a lower peripheral wall 236 that protrudes downward from the second plate 226. The lower peripheral wall 236 may be disposed in contact with the inner surface of the outer water tank wall 172 of the heating water tank 170. In addition, a first sealer 238 may be disposed between the lower peripheral wall 236 and the outer water tank wall 172 to prevent air or water vapor inside the heating chamber 170*a* from leaking to the outside.

A plurality of first coupling protrusions 228 coupled to the second fastening protrusions 154 of the upper plate 146 may be disposed in the second plate 226. A second coupling protrusion 229 coupled to the water supply pipe 240 may be disposed in the second plate 226.

Water Supply Pipe>

Figure 26:
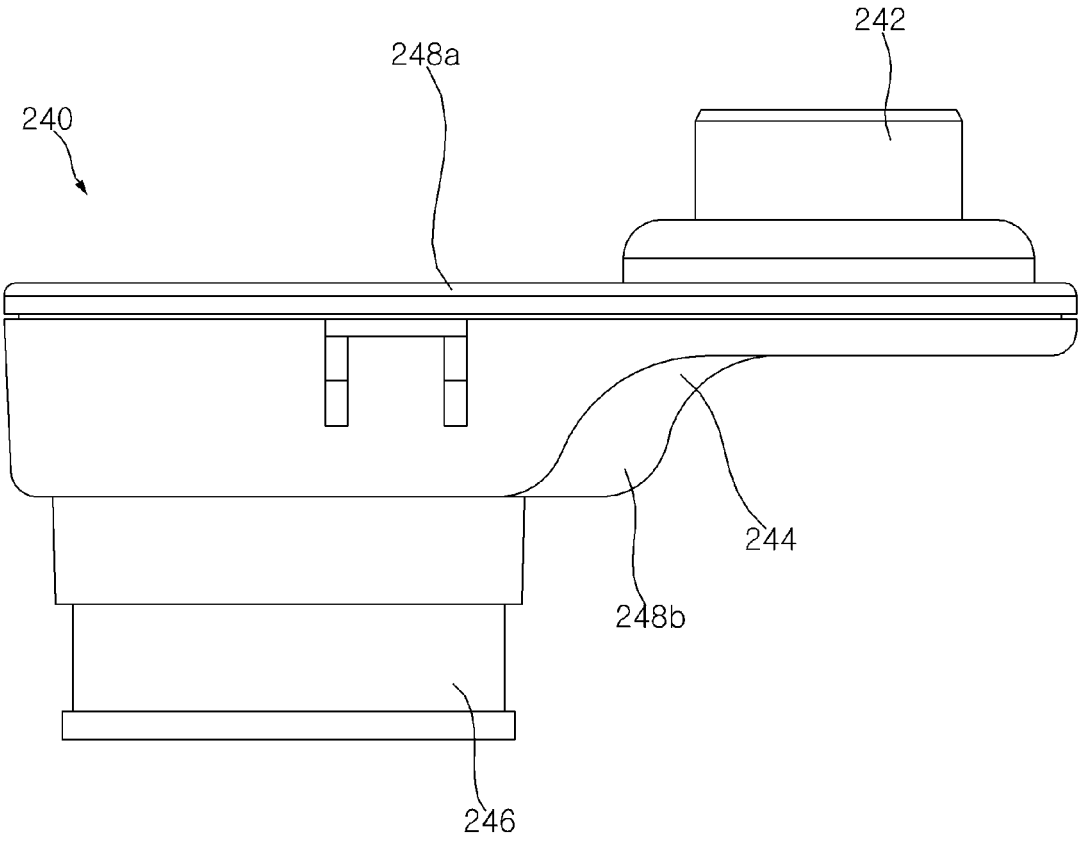
FIG. 26 is a side view of a water supply pipe according to an embodiment of the present disclosure.

Hereinafter, a water supply pipe according to an embodiment of the present disclosure will be described with reference to FIGS. 26 and 27.

The water supply pipe 240 may supply water stored in the water tank 110 to the heating water tank 170. The water supply pipe 240 is disposed in the lower side of the water tank 110. The water supply pipe 240 is disposed in the upper side of the heating water tank 170. The water supply pipe 240 may form a water supply passage 240*a* through which water flows by gravity. The water supply passage 240*a* may have a bent shape.

The water supply pipe 240 includes a water tank connector 242 that is coupled to the water tank 110. The water tank connector 242 may lift the cap 118 of the water tank 110, when the water tank 110 is disposed in the upper side of the water supply pipe 240. When the water tank 110 is mounted in the upper side of the water supply pipe 240, the water tank connector 242 lifts the cap 118 so that the water stored in the water tank 110 can flow into the water supply pipe 240.

The water supply pipe 240 includes a lower supply pipe 246 which is disposed to be spaced apart from the water tank connector 242 in the up-down direction and spaced apart from the water tank connector 242 in a direction perpendicular to the up-down direction, and an upper supply pipe 244 connecting the water tank connector 242 and the lower supply pipe 246.

The center of the water tank 110 and the center of the heating water tank 170 may be disposed to be spaced apart from each other. Accordingly, the upper and lower ends of the water supply pipe 240 are disposed to be spaced apart in a direction perpendicular to the up-down direction. Accordingly, the lower supply pipe 246 is disposed to be spaced apart from the water tank connector 242 in a direction perpendicular to the up-down direction.

The lower supply pipe 246 is disposed inside the water supply tank 222 of the second connector 220. The outer circumference of the lower supply pipe 246 may be disposed in contact with the inner circumference of the water supply tank 222. A second sealer 247 may be disposed between the lower supply pipe 246 and the water supply tank 222. The second sealer 247 may allow the water flowing into the water supply tank 222 to flow only into the heating water tank 170.

The upper supply pipe 244 may have a structure extending in a direction perpendicular to the up-down direction.

Figure 27:
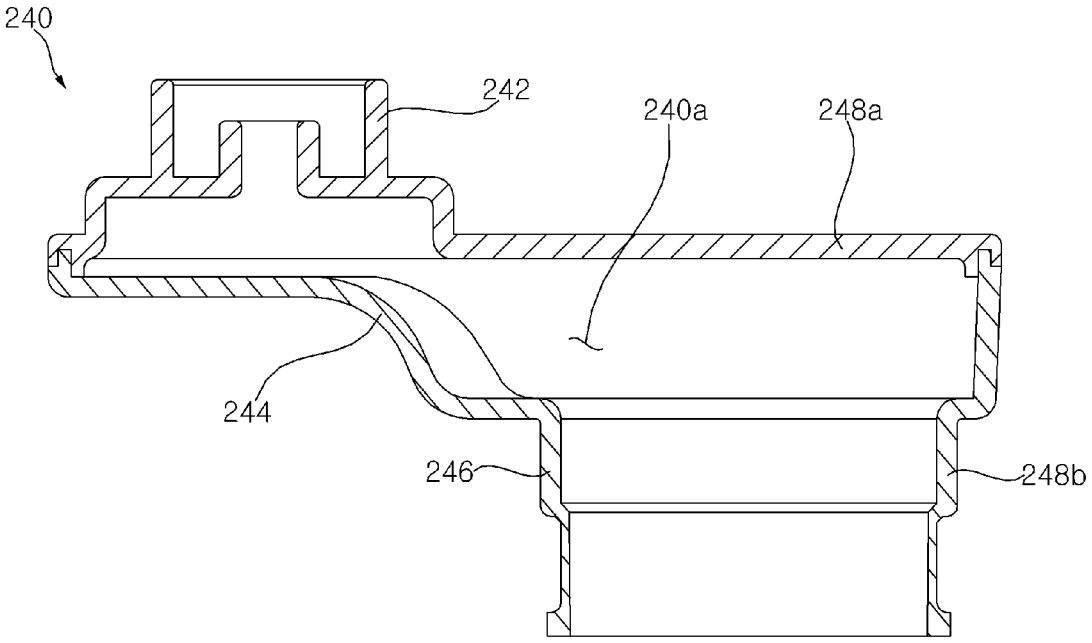
FIG. 27 is a cross-sectional view of one side of FIG. 26.

Referring to FIG. 27, the water supply pipe 240 may have a structure in which two components, i.e., an upper cover 248*a* and a lower cover 248*b*, are coupled. The water tank connector 242 is disposed in the upper cover 248*a*. The lower supply pipe 246 is disposed in the lower cover 248*b*. The upper supply pipe 244 may be disposed in the area where the upper cover 248*a* and the lower cover 248*b* are coupled. The upper cover 248*a* and the lower cover 248*b* may be coupled by fusion.

Connection Pipe>

Figure 28:
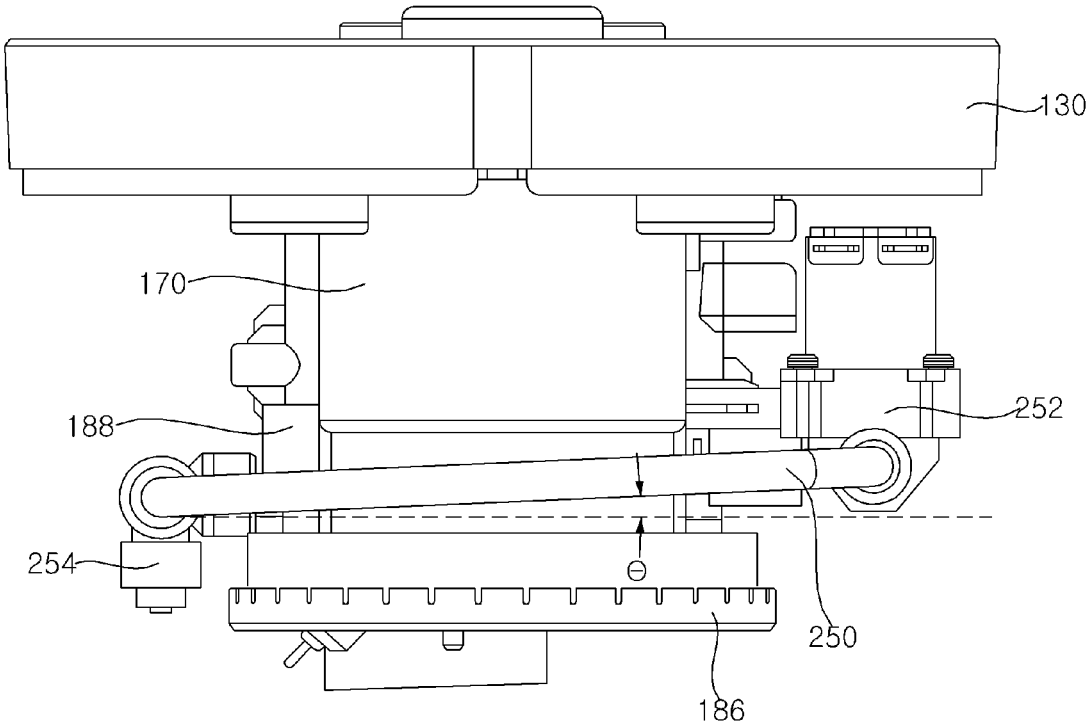
FIG. 28 is a front view of a state where a humidifying water tank, a heating water tank, a first connector, a second connector, and a water supply pipe are coupled according to an embodiment of the present disclosure.

The connection pipe 250 connects the heating chamber 170*a* and the humidifying chamber 130*a*. The connection pipe 250 supplies water stored in the heating chamber 170*a* to the humidifying chamber 130*a*. The connection pipe 250 connects the water inlet pipe 134 of the heating chamber 170*a* and the water discharge pipe 174 of the humidifying chamber 130*a*. The connection pipe 250 may have a structure whose height is lowered as it progresses from the water inlet pipe 134 to the water discharge pipe 174. In addition, the connection pipe 250 may have a structure whose height is maintained as it progresses from the water inlet pipe 134 to the water discharge pipe 174. Referring to FIG. 28, the connection pipe 250 may form an inclination angle θ such that its height changes as it progresses from the water inlet pipe 134 to the water discharge pipe 174.

In one side of the connection pipe 250, a connection pipe valve 252 is disposed to open and close the first connection passage 250*a* formed inside the connection pipe 250. The connection pipe valve 252 may use a solenoid valve. The connection pipe valve 252 may open and close the inside of the connection pipe 250 according to an electrical signal. When the passage inside the connection pipe 250 is opened by the connection pipe valve 252, water inside the heating chamber 170*a* may flow to the humidifying chamber 130*a*. The connection pipe 250 is disposed to extend along the circumference of the heating water tank 170 while being spaced apart from the heating water tank 170.

The connection pipe valve 252 may open the passage inside the connection pipe 250, when the water temperature inside the heating water tank 170 detected by the temperature sensor 188 is a set temperature or higher.

The connection pipe valve 252 may be disposed closer to the water inlet pipe 134 than the water discharge pipe 174.

An ion sensor 254 may be disposed in one side of the connection pipe 250 to measure the amount of ions contained in the water supplied to the humidifying water tank 130.

According to the humidifier of the present disclosure, one or more of the following effects are achieved.

First, the humidifier of the present disclosure may form a discharge passage around a column-shaped water tank to expand an area where humidified air is discharged, thereby sending humidified air to a wide area of the indoor space.

Second, the humidifier of the present disclosure can efficiently process condensed water formed on the discharge passage by supplying condensed water formed around the water tank to the humidifying water tank through a bottom wall.

Third, it is possible to minimize the generation of condensed water in the inner water tank that is mainly used by a user, by providing a plurality of water tanks.

Fourth, it is possible to prevent condensed water that may occur between a plurality of water tanks from flowing into a second bottom hole connected to a water supply pipe, by adjusting the size of a through-hole of an outer water tank.

The disclosure has been made in view of the above problems, and may provide a humidifier that expands an area where humidified air is discharged by adjusting the disposition of a water tank.

The disclosure may further provide a humidifier that supplies condensation water formed around the water tank according to the disposition of the water tank to a humidifying water tank.

The disclosure may further provide a humidifier that minimizes the formation of condensed water by using a water tank mainly used by a user, when there are a plurality of water tanks.

The disclosure may further provide a humidifier that prevents condensation water that may occur between a plurality of water tanks from flowing into spaces excluding a discharge passage.

In accordance with an aspect of the present disclosure, a humidifier includes: a water tank for storing water; a humidifying water tank which is disposed in a lower side of the water tank, and generates humidified air by using water supplied to the water tank; a water supply pipe which is disposed in the lower side of the water tank, and supplies the water supplied from the water tank to the humidifying water tank; and an inner guider disposed spaced apart from an outer circumference of the water tank, wherein a discharge passage through which the humidified air generated in the humidifying water tank flows is formed between the water tank and the inner guide, wherein the inner guider includes a bottom wall which has a first bottom hole that is disposed in the lower side of the water tank and communicates the humidifying water tank and the discharge passage, and a second bottom hole in which at least a portion of the water tank and the water supply pipe is disposed, wherein the bottom wall forms an inclined surface such that a height of the first bottom hole is formed lower than a height of the second bottom hole, so that condensate water generated in the discharge passage may flow along the inclined surface of the bottom wall and flow back into the humidifying water tank.

The bottom wall includes a first pipe protruding downward from an outer circumference of the first bottom hole, and a second pipe protruding upward from an outer circumference of the second bottom hole, so that condensate water flowing along the bottom wall can be discharged into the first pipe. Additionally, condensate water flowing along the bottom wall does not flow into the second bottom hole.

An exhaust pipe is formed in the humidifying water tank to send the humidified air generated in the humidifying water tank to the discharge passage, and the first pipe is disposed to be inserted into the exhaust pipe, so that condensate water can flow into the humidifying water tank along the first pipe and the exhaust pipe.

The second bottom hole is disposed in a center of the bottom wall, and the first bottom hole is disposed to be radially spaced from the second bottom hole.

In the bottom wall, an inclination angle formed between a surface extending from the first bottom hole in a direction in which the second bottom hole is disposed and a virtual horizontal line is formed to be smaller than an inclination angle formed between a surface extending from the first bottom hole in an opposite direction in which the second bottom hole is disposed and a virtual horizontal line, so that the height of the upper end of the bottom wall can be made the same.

The first bottom hole and the second bottom hole are open toward a lower surface of the water tank, so that humidified air flowing through the first bottom hole may be discharged between the lower surface of the water tank and the bottom wall and flow into the discharge passage.

The water tank includes an inner water tank which stores water, and an outer water tank which is disposed around an outer circumference of the inner water tank and fixes a disposition of the inner water tank, wherein the inner water tank penetrates the outer water tank and is connected to the water supply pipe, thereby minimizing the generation of condensate water around the inner water tank.

The outer water tank includes a barrier protruding outward in a radial direction at a lower end of the outer water tank, so that the humidified air discharged to the first bottom hole may be dispersed and flow throughout a space between the outer circumference of the water tank and the inner circumference of the inner guider.

A length of the barrier protruding in the radial direction from the lower end of the outer water tank is formed to be different depending on a distance spaced apart from the first bottom hole, so that the humidified air discharged to the first bottom hole may be dispersed and flow throughout the space between the outer circumference of the water tank and the inner circumference of the inner guider.

The outer water tank includes a plurality of fixing protrusions protruding downward to fix the outer water tank to the inner guider, so that the outer water tank may be fixedly disposed in the upper side of the bottom wall.

A plurality of fixing protrusion grooves into which the plurality of fixing protrusions are inserted are formed in the bottom wall, so that the outer water tank may be fixedly disposed in the upper side of the bottom wall.

A through-hole is formed in a lower surface of the outer water tank, and a lower portion of the inner water tank is disposed to penetrate the through-hole, so that the inner water tank can be directly connected to the water supply pipe.

The through-hole is disposed in an upper side of the second bottom hole, a second pipe protruding upward along an outer circumference of the second bottom hole is disposed on the bottom wall, and a diameter of an inner circumferential surface of the through-hole is formed larger than a diameter of an outer circumferential surface of the second pipe, so that condensate water flowing between the inner water tank and the outer water tank can be prevented from flowing into the second bottom hole.

An upper end of the second pipe is disposed in contact with a lower side of the inner water tank, so that the disposition of the inner water tank can be maintained stably.

The inner water tank includes: an inner housing which forms a space for storing water therein and has a tank hole formed in a lower portion; a cap disposed to open and close the tank hole; and a tank connector extending downward around the tank hole, wherein the tank connector is disposed to be inserted into an interior of the second pipe.

In accordance with another aspect of the present disclosure, a humidifier includes: a water tank for storing water; a heating water tank which is disposed in a lower side of the water tank, and heats water received from the water tank; a humidifying water tank which is disposed in a lower side of the water tank, and generates humidified air by receiving the water heated in the heating water tank; and an inner guider disposed spaced apart from an outer circumference of the water tank, wherein a discharge passage through which the humidified air generated in the humidifying water tank flows is formed between the water tank and the inner guide, wherein the inner guider includes a bottom wall which has a first bottom hole that is disposed in the lower side of the water tank and communicates the humidifying water tank with the discharge passage, wherein the humidifying water tank includes an exhaust pipe extending downward from an upper portion of the humidifying water tank to communicate an interior of the humidifying water tank with the discharge passage, wherein the exhaust pipe is disposed in a lower side of the first bottom hole, so that condensed water generated on the discharge passage may flow into the humidifying water tank.

The humidifier further includes: a first connection pipe which supplies the water heated in the heating water tank to the humidifying water tank; and a second connection pipe which is disposed to be spaced upward from the first connection pipe and connects the heating water tank and the humidifying water tank, wherein the second connection pipe is opened toward a circumferential surface of the exhaust pipe, so that humidified air generated in the heating water tank may flow into the discharge passage through the exhaust pipe.

The exhaust pipe protrudes lower than the second connection pipe, so that condensate water flowing from the discharge passage can be supplied into the humidifying water tank.

A middle hole opened toward the second connection pipe is formed in the circumferential surface of the exhaust pipe, so that humidified air generated in the heating water tank may flow into the discharge passage through the exhaust pipe.

Although the present disclosure has been described with reference to specific embodiments shown in the drawings, it is apparent to those skilled in the art that the present description is not limited to those exemplary embodiments and is embodied in many forms without departing from the scope of the present disclosure, which is described in the following claims. These modifications should not be individually understood from the technical concept or scope of the present disclosure.

It will be understood that when an element or layer is referred to as being "on" another element or layer, the element or layer can be directly on another element or layer or intervening elements or layers. In contrast, when an element is referred to as being "directly on" another element or layer, there are no intervening elements or layers present. As used herein, the term "and/or" includes any and all combinations of one or more of the associated listed items.

It will be understood that, although the terms first, second, third, etc., may be used herein to describe various elements, components, regions, layers and/or sections, these elements, components, regions, layers and/or sections should not be limited by these terms. These terms are only used to distinguish one element, component, region, layer or section from another region, layer or section. Thus, a first element, component, region, layer or section could be termed a second element, component, region, layer or section without departing from the teachings of the present invention.

Spatially relative terms, such as "lower", "upper" and the like, may be used herein for ease of description to describe the relationship of one element or feature to another element(s) or feature(s) as illustrated in the figures. It will be understood that the spatially relative terms are intended to encompass different orientations of the device in use or operation, in addition to the orientation depicted in the figures. For example, if the device in the figures is turned over, elements described as "lower" relative to other elements or features would then be oriented "upper" relative to the other elements or features. Thus, the exemplary term "lower" can encompass both an orientation of above and below. The device may be otherwise oriented (rotated 90 degrees or at other orientations) and the spatially relative descriptors used herein interpreted accordingly.

The terminology used herein is for the purpose of describing particular embodiments only and is not intended to be limiting of the invention. As used herein, the singular forms "a", "an" and "the" are intended to include the plural forms as well, unless the context clearly indicates otherwise. It will be further understood that the terms "comprises" and/or "comprising," when used in this specification, specify the presence of stated features, integers, steps, operations, elements, and/or components, but do not preclude the presence or addition of one or more other features, integers, steps, operations, elements, components, and/or groups thereof.

Embodiments are described herein with reference to cross-section illustrations that are schematic illustrations of idealized embodiments (and intermediate structures). As such, variations from the shapes of the illustrations as a result, for example, of manufacturing techniques and/or tolerances, are to be expected. Thus, embodiments should not be construed as limited to the particular shapes of regions illustrated herein but are to include deviations in shapes that result, for example, from manufacturing.

Unless otherwise defined, all terms (including technical and scientific terms) used herein have the same meaning as commonly understood by one of ordinary skill in the art to which this invention belongs. It will be further understood that terms, such as those defined in commonly used dictionaries, should be interpreted as having a meaning that is consistent with their meaning in the context of the relevant art and will not be interpreted in an idealized or overly formal sense unless expressly so defined herein.

Any reference in this specification to "one embodiment," "an embodiment," "example embodiment," etc., means that a particular feature, structure, or characteristic described in connection with the embodiment is included in at least one embodiment. The appearances of such phrases in various places in the specification are not necessarily all referring to the same embodiment. Further, when a particular feature, structure, or characteristic is described in connection with any embodiment, it is submitted that it is within the purview of one skilled in the art to effect such feature, structure, or characteristic in connection with other ones of the embodiments.

Although embodiments have been described with reference to a number of illustrative embodiments thereof, it should be understood that numerous other modifications and embodiments can be devised by those skilled in the art that will fall within the spirit and scope of the principles of this disclosure. More particularly, various variations and modifications are possible in the component parts and/or arrangements of the subject combination arrangement within the scope of the disclosure, the drawings and the appended claims. In addition to variations and modifications in the component parts and/or arrangements, alternative uses will also be apparent to those skilled in the art.

What is claimed is:

1. A humidifier, comprising:

a water tank for storing water;

a humidifying water tank which is disposed in a lower side of the water tank, and generates humidified air by using water supplied to the water tank;

a water supply pipe which is disposed in the lower side of the water tank, and supplies the water supplied from the water tank to the humidifying water tank; and an inner guider disposed spaced apart from an outer circumference of the water tank, wherein a discharge passage through which the humidified air generated in the humidifying water tank flows is formed between the water tank and the inner guider, wherein the inner guider comprises a bottom wall which has a first bottom hole that is disposed in the lower side of the water tank and communicates with the humidifying water tank and the discharge passage, and a second bottom hole in which at least a portion of the water tank and the water supply pipe is disposed, wherein the bottom wall forms an inclined surface so that the first bottom hole is located lower than the second bottom hole.

2. The humidifier of claim 1, wherein the bottom wall comprises a first pipe protruding downward from an outer circumference of the first bottom hole, and a second pipe protruding upward from an outer circumference of the second bottom hole.

3. The humidifier of claim 2, wherein an exhaust pipe is formed in the humidifying water tank to send the humidified air generated in the humidifying water tank to the discharge passage, wherein the first pipe is disposed to be inserted into the exhaust pipe.

4. The humidifier of claim 1, wherein an area of the first bottom hole is formed to be smaller than an area of a lower surface of the water tank.

5. The humidifier of claim 1, wherein the second bottom hole is disposed in a center of the bottom wall, and the first bottom hole is disposed to be radially spaced from the second bottom hole.

6. The humidifier of claim 1, wherein in the bottom wall, an inclination angle formed between a surface extending from the first bottom hole in a direction in which the second bottom hole is disposed and a virtual horizontal line is formed to be smaller than an inclination angle formed between a surface extending from the first bottom hole in an opposite direction in which the second bottom hole is disposed and a virtual horizontal line.

7. The humidifier of claim 1, wherein the first bottom hole and the second bottom hole are open toward a lower surface of the water tank.

8. The humidifier of claim 1, wherein the water tank comprises an inner water tank which stores water, and an outer water tank which is disposed around an outer circumference of the inner water tank and fixes a disposition of the inner water tank, wherein the inner water tank penetrates the outer water tank and is connected to the water supply pipe.

9. The humidifier of claim 8, wherein the outer water tank comprises a barrier protruding outward in a radial direction at a lower end of the outer water tank.

10. The humidifier of claim 9, wherein a length of the barrier protruding in the radial direction from the lower end of the outer water tank is formed to be different depending on a distance spaced apart from the first bottom hole.

11. The humidifier of claim 8, wherein the outer water tank comprises a plurality of fixing protrusions protruding downward to fix the outer water tank to the inner guider.

12. The humidifier of claim 11, wherein a plurality of fixing protrusion grooves into which the plurality of fixing protrusions are inserted are formed in the bottom wall.

13. The humidifier of claim 10, wherein a through-hole is formed in a lower surface of the outer water tank, wherein a lower portion of the inner water tank is disposed to penetrate the through-hole.

14. The humidifier of claim 13, wherein the through-hole is disposed in an upper side of the second bottom hole, wherein a second pipe protruding upward along an outer circumference of the second bottom hole is disposed on the bottom wall, wherein a diameter of an inner circumferential surface of the through-hole is formed larger than a diameter of an outer circumferential surface of the second pipe.

15. The humidifier of claim 14, wherein an upper end of the second pipe is disposed in contact with a lower side of the inner water tank.

16. The humidifier of claim 14, wherein the inner water tank comprises:

an inner housing which forms a space for storing water therein and has a tank hole formed in a lower portion;

a cap disposed to open and close the tank hole; and a tank connector extending downward around the tank hole, wherein the tank connector is disposed to be inserted into an interior of the second pipe.

* * * * *